US012733710B2

(12) United States Patent
Cobb

(10) Patent No.: US 12,733,710 B2
(45) **Date of Patent: *Sep. 15, 2026**

(54) FOOTWEAR SOLE AND RELATED METHOD OF USE

(71) Applicant: Wolverine Outdoors, Inc., Rockford, MI (US)

(72) Inventor: Ian M. Cobb, Rockford, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/183,169

(22) Filed: Apr. 18, 2025

(65) Prior Publication Data

US 2026/0157470 A1 Jun. 11, 2026

Related U.S. Application Data

(63) Continuation of application No. 18/590,372, filed on Feb. 28, 2024, now Pat. No. 12,302,980.

(Continued)

(51) Int. Cl.

| | |
|---|---|
| ***A43B 13/02*** | (2022.01) |
| ***A43B 13/14*** | (2006.01) |
| ***A43B 13/37*** | (2006.01) |

(52) U.S. Cl.

CPC ..... *A43B 13/02* (2013.01); *A43B 13/145* (2013.01); *A43B 13/146* (2013.01); *A43B 13/37* (2013.01)

(58) Field of Classification Search

None

See application file for complete search history.

(56) References Cited

U.S. PATENT DOCUMENTS 3,082,556 A * 3/1963 Schwartz ..... G09F 3/00 40/636

4,999,931 A * 3/1991 Vermeulen ..... A43B 13/185 36/153

(Continued)

FOREIGN PATENT DOCUMENTS

EP 0434076 A2 6/1991

OTHER PUBLICATIONS

Speedland, GS Oak, (https://www.runspeedland.com/products/gs-oak), at least as early as Feb. 28, 2024.

(Continued)

*Primary Examiner* — Bao-Thieu L Nguyen

(74) *Attorney, Agent, or Firm* — Warner Norcross + Judd LLP

(57) ABSTRACT

A footwear including a sole assembly having an upper midsole, a lower midsole, and a plate sandwiched therebetween. One or both of the upper and lower midsoles can include upper and/or lower pillars that cooperatively form an upper or lower void and/or compartment above or below the plate. The lower void and/or compartment below the plate can be disposed vertically below the upper void, with the plate separating the voids and/or compartments. The voids, compartments, plates and pillars can collapse to provide cushion and energy return. The upper plate can undulate from toe to heel, concave in the forefoot, convex in the arch and concave in the heel. The upper midsole can include a weight bearing surface with at least a 10 mm heel to toe drop. The plate can form a branding bridge between upper pillars, with an indicia element exposed in the upper void for advertising on the plate.

19 Claims, 20 Drawing Sheets

Related U.S. Application Data

(60) Provisional application No. 63/540,402, filed on Sep. 26, 2023, provisional application No. 63/469,995, filed on May 31, 2023.

(56) References Cited

U.S. PATENT DOCUMENTS

| | | | | |
|---|---|---|---|---|
| D350,020 | S | 8/1994 | Kilgore | |
| D350,225 | S | 9/1994 | Kilgore | |
| D350,226 | S | 9/1994 | Kilgore | |
| D350,227 | S | 9/1994 | Kilgore | |
| 5,343,639 | A | 9/1994 | Kilgore et al. | |
| 5,572,805 | A | 11/1996 | Giese et al. | |
| 5,611,152 | A | 3/1997 | Richard et al. | |
| 5,980,351 | A * | 11/1999 | McCook | A43B 3/0026 36/15 |
| D429,877 | S | 8/2000 | Lozano et al. | |
| 6,260,291 | B1 | 7/2001 | Farys | |
| 6,385,864 | B1 | 5/2002 | Sell, Jr. et al. | |
| D462,830 | S | 9/2002 | Greene | |
| 6,455,128 | B1 * | 9/2002 | Moon | G09F 21/02 428/203 |
| 6,457,261 | B1 | 10/2002 | Crary | |
| D474,582 | S | 5/2003 | Cooper | |
| 6,625,905 | B2 * | 9/2003 | Kita | A43B 13/12 36/28 |
| D522,741 | S | 6/2006 | Aveni et al. | |
| 7,096,605 | B1 * | 8/2006 | Kozo | A43B 7/26 36/76 R |
| 7,162,815 | B2 * | 1/2007 | Miyauchi | A43B 13/181 36/31 |
| 7,213,354 | B1 * | 5/2007 | Byrd | A43B 7/144 36/25 R |
| 7,329,019 | B2 * | 2/2008 | Cheung | A43B 1/0027 362/228 |
| 7,565,754 | B1 * | 7/2009 | Acheson | A43B 13/026 36/144 |
| 7,832,117 | B2 | 11/2010 | Auger et al. | |
| 7,886,460 | B2 * | 2/2011 | Teteriatnikov | A43B 13/145 36/31 |
| 7,950,112 | B2 | 5/2011 | Hammerslag et al. | |
| 7,971,372 | B2 | 7/2011 | Macey et al. | |
| D650,978 | S | 12/2011 | Lee | |
| 8,302,233 | B2 | 11/2012 | Spanks et al. | |
| 8,516,724 | B2 * | 8/2013 | Diepenbrock | A43B 3/0078 36/112 |
| 8,567,093 | B2 | 10/2013 | Sato | |
| 8,615,902 | B2 | 12/2013 | Macey et al. | |
| 8,656,609 | B2 | 2/2014 | Macey et al. | |
| 8,756,831 | B2 | 6/2014 | Spanks et al. | |
| 8,813,390 | B2 | 8/2014 | Auger et al. | |
| 8,978,273 | B2 | 3/2015 | Cook et al. | |
| D751,281 | S | 3/2016 | Nickel et al. | |
| 9,510,646 | B2 | 12/2016 | Holt | |
| 9,750,305 | B2 | 9/2017 | Spanks et al. | |
| 10,016,012 | B2 | 7/2018 | Auger et al. | |
| 10,016,017 | B2 | 7/2018 | Christensen | |
| D825,902 | S | 8/2018 | Tokumoto | |
| 10,349,700 | B2 | 7/2019 | Amis et al. | |
| 10,441,027 | B2 | 10/2019 | Bartel et al. | |
| 10,448,704 | B2 | 10/2019 | Dupre et al. | |
| 10,463,104 | B2 | 11/2019 | Spanks et al. | |
| 10,548,368 | B2 | 2/2020 | Bartel et al. | |
| 10,561,198 | B2 | 2/2020 | Luedecke et al. | |
| 10,743,606 | B2 | 8/2020 | Bartel et al. | |
| 10,798,992 | B2 | 10/2020 | Bartel et al. | |
| 10,842,224 | B2 | 11/2020 | Farina et al. | |
| 11,344,081 | B2 | 5/2022 | Dupre et al. | |
| 11,357,286 | B2 | 6/2022 | Dupre et al. | |
| 11,497,278 | B2 | 11/2022 | Aoki et al. | |
| D980,609 | S | 3/2023 | Cook et al. | |
| 11,918,074 | B2 | 3/2024 | Elder et al. | |
| 12,064,005 | B2 | 8/2024 | Heitz et al. | |
| 12,302,980 | B2 * | 5/2025 | Cobb | A43B 13/02 |
| 2004/0194347 | A1 * | 10/2004 | Aveni | A43B 7/1464 36/91 |
| 2004/0221483 | A1 * | 11/2004 | Cartier | A43B 13/181 36/27 |
| 2006/0277791 | A1 * | 12/2006 | Schoenborn | A43B 13/186 36/28 |
| 2008/0250673 | A1 * | 10/2008 | Andrews | A43B 13/188 36/25 R |
| 2010/0122476 | A1 * | 5/2010 | Le | A43B 13/125 12/146 B |
| 2011/0131832 | A1 | 6/2011 | Brandt et al. | |
| 2013/0167401 | A1 * | 7/2013 | Christensen | A43B 13/20 36/29 |
| 2013/0167402 | A1 * | 7/2013 | Christensen | A43B 13/184 36/29 |
| 2013/0212909 | A1 * | 8/2013 | Bates | A43B 13/203 36/102 |
| 2014/0020264 | A1 | 1/2014 | Holt | |
| 2016/0067584 | A1 | 3/2016 | Giedwoyn et al. | |
| 2018/0213886 | A1 * | 8/2018 | Connell | A43B 13/186 |
| 2018/0338577 | A1 * | 11/2018 | Elder | A43B 3/0057 |
| 2019/0289961 | A1 * | 9/2019 | Iuchi | A43B 13/026 |
| 2020/0121021 | A1 | 4/2020 | Bartel et al. | |
| 2020/0154825 | A1 | 5/2020 | Case et al. | |
| 2020/0367603 | A1 | 11/2020 | Bartel et al. | |
| 2021/0007439 | A1 | 1/2021 | Bartel et al. | |
| 2021/0052036 | A1 | 2/2021 | Farina et al. | |
| 2021/0227929 | A1 * | 7/2021 | Ni | A43B 13/37 |
| 2021/0227931 | A1 | 7/2021 | Dupre et al. | |
| 2021/0227933 | A1 | 7/2021 | Farina et al. | |
| 2021/0353001 | A1 * | 11/2021 | Elder | A43B 13/127 |
| 2022/0031017 | A1 | 2/2022 | Heitz et al. | |
| 2022/0031018 | A1 | 2/2022 | Bernhard et al. | |
| 2022/0031024 | A1 | 2/2022 | Cook et al. | |
| 2022/0047040 | A1 * | 2/2022 | Durflinger | A43B 21/32 |
| 2022/0142296 | A1 | 5/2022 | Head et al. | |
| 2022/0202137 | A1 | 6/2022 | Kiss | |
| 2023/0124653 | A1 * | 4/2023 | Farina | A43B 13/41 36/25 R |
| 2023/0140074 | A1 * | 5/2023 | Bernhard | A43B 13/026 36/28 |
| 2023/0148712 | A1 | 5/2023 | Ouchi et al. | |
| 2024/0099422 | A1 * | 3/2024 | Narriman | A43B 13/125 |
| 2024/0407498 | A1 | 12/2024 | Oleson et al. | |

OTHER PUBLICATIONS

Altra, Mont Blanc Boa, (https://www.altrarunning.eu/catalog/product/view/id/6605/?geolocation=1&notgeolocalized=1), at least as early as Feb. 28, 2024.

LA Sportiva, Jackal II Boa, (https://www.lasportivausa.com/jackal-ii-boa.html), at least as early as Feb. 28, 2024.

Scott, MTB RC SL Boa, (https://www.boafit.com/en-us/products/scott-mtb-rc-sl/1631.html), at least as early as Feb. 28, 2024.

Fizik, Vento Stabilita Carbon, (https://www.fizik.com/us_en/vento-stabilita-carbon.html), at least as early as Feb. 28, 2024.

Shimano, S-Phyre SH-RC902, (https://www.boafit.com/en-us/products/shimano-s-phyre-sh-rc902/1630.hmlt), at least as early as Feb. 28, 2024.

Gaerne, Carbon G.SNX, (https://www.boafit.com/en-us/products/gaerne-carbon-gsnx/1757.html), at least as early as Feb. 28, 2024.

Specialized, S Works Ares, (https://www.specialized.com/us/en/s-works-ares-road-shoes/p/187397?color=300641-187397), at least as early as Feb. 28, 2024.

* cited by examiner

FOOTWEAR SOLE AND RELATED METHOD OF USE

BACKGROUND OF THE INVENTION

The present invention relates to footwear, and more particularly to a sole assembly for footwear with improved stability, energy efficiency and traction.

A typical footwear construction includes an upper joined with a sole assembly. The sole assembly underlies the wearer's foot and provides a ground-engaging surface that protects the wearer's foot. In addition to protecting the wearer's foot, sole assemblies are often designed to provide the desired support, energy return and traction. To achieve these objectives, footwear is available with a wide variety of different soles or sole assemblies.

In many footwear, a sole assembly incorporates a midsole to provide cushioning, some stability and energy return. The midsole can be constructed from a variety of materials to provide the above functional characteristics. Frequently, sole assemblies also include a plate that is substantially more rigid than the cushioning materials of the midsole, to effectively compliment the midsole with its functionality. Plates are typically designed, at least in hiking footwear, to provide support and stability, yet still bend and provide energy return to a wearer of the footwear when performing such activities.

The properties of a sole assembly are complex and depend greatly on a variety of factors, most notably the design and configuration of the plate and the construction and configuration of cushioning materials of the midsole with which the plate is combined. As a result, a wide range of plated sole assemblies have been developed for a variety of different applications, such as hiking, walking and trail running activities. The rigidity of the plate, the position of the plate within the sole assembly, the shape of the plate, the material from which the plate is manufactured, the impact absorption of cushioning materials in the midsole, the position of the cushioning material relative to the plate and the wearer's foot are all factors that contribute to the overall properties and design of a sole assembly. Changing one or more of these factors can greatly alter the support, stability, cushioning and energy return of the sole assembly. In some cases, a change can make the footwear less comfortable and overly stiff for a range of applications. In other cases, a change can alter the support and energy return properties provided by the plate.

Similarly, the cushioning materials of the midsole can be selected to complement the plate and to give the sole assembly suitable cushioning, comfort and energy return characteristics. Too little cushioning material may not provide adequate cushioning and may reduce the comfort level of the sole assembly. On the other hand, too much cushioning material may make the sole assembly excessively thick and may reduce the effectiveness of the plate by absorbing too much of the energy returned by the plate.

As can be seen, a variety of properties can be adjusted to tune a sole assembly for an intended application. Despite this general understanding within the footwear industry, ideal plated sole assemblies with cushioning systems have not been developed for many different footwear applications. As a result, there remains a need for a plated sole assembly that provides an optimized combination of support, cushioning, energy return and traction for use in footwear, used, for example, in hiking and trail running, among other activities.

SUMMARY OF THE INVENTION

A footwear construction including a sole assembly is provided. The sole assembly can include an upper midsole, a lower midsole and a plate sandwiched therebetween.

In one embodiment, the upper midsole can include upper pillars that cooperatively form an upper void above the plate. The lower midsole can include lower pillars that cooperatively form a lower void below the plate, and disposed vertically below the upper void, with the plate located between the voids. The voids, plates and pillars can collapse, morph in shape and/or dynamically move relative to one another to provide exceptional cushioning and energy return in a footwear with which the sole assembly is associated.

In another embodiment, the upper plate can undulate from toe to heel. For example, the plate can be concave in the forefoot, convex in the arch and again concave in the heel. This can allow the plate to better conform to a wearers' foot and translate to better energy return and/or stability provided by the footwear.

In a further embodiment, the sole assembly or upper midsole can include a weight bearing surface with a predetermined heel to toe drop. This heel to toe drop can be, for example, an 8 mm, a 10 mm, a 12 mm and/or a 14 mm heel to toe drop. The heel to toe drop, in combination with the upper and lower midsoles plus plate in some cases can propel a user into their next stride, thereby effectively providing forward momentum via the footwear.

In still another embodiment, the plate can form a branding bridge between pillars in the sole assembly, with an indicia element exposed in an upper void to provide advertising, images or other aesthetic features on the plate, inset from the sidewalls of the pillars and within the void. The branding bridge can display the indicia element within the upper void to a user viewing the sole assembly from the upper view thereof.

In yet another embodiment, the plate can define multiple indentations extending inward from a lateral plate edge and a medial plate edge. These indentations can include a first indentation aligned with and extending inward toward the longitudinal axis of the sole assembly in a first location such that the upper void is vertically aligned above the first indentation and the lower void is vertically aligned below the first indentation. Another indentation can be paired with this indentation on the other side of the longitudinal axis and sole assembly, and likewise can be located so the upper void is vertically aligned above that indentation, and the lower void is vertically aligned below it. In these constructions, a vertical line or plane can pass through and/or intersect each of the upper void, the indentation and the lower void.

In even another embodiment, the plate can include reinforced regions aligned with the indentations and/or aligned with the upper and lower voids. The reinforced regions' plate projections can include a first thickness greater than a second thickness in other regions of the plate, and can extend laterally across the width of the sole assembly or between voids on opposite sides of the plate. In some cases, the plate can be thicker in the reinforced regions, and can form outlines or recesses corresponding to the edges or perimeters of the pillars.

In a further embodiment, the other regions of the plate with the second thickness, less than the first thickness, can be aligned with and secured to upper and lower pillars disposed on opposing upper and lower surfaces of the plate. The thinner regions of the plate can be joined with the lower surfaces of the upper pillars and the upper surfaces of the lower pillars. The thicker reinforced regions of the plate spanning through the voids can balance or equilibrate with the thinner regions of the plate joined with the upper and lower pillars, so that the plate can flex, bend or move more evenly or consistently throughout than if the plate is of a uniform thickness throughout the entire length and width of the plate.

In still a further embodiment, the thicker and thinner regions of the plate can function to precisely locate the respective pillars along the plate. The pillars can be aligned with the thinner regions, between the thicker regions, which can form shoulders to assist in placement of the pillars. The pillars can nest within the thinner regions, while the shoulders or edges of the thicker regions serve as a boundary or perimeter to precisely locate the pillars within the thinner regions, which can correspond to one or more recesses in the surfaces of the plate.

In yet a further embodiment, the sole assembly can include an outsole disposed below the lower midsole and under the entire sole assembly. This outsole can offer protection to prevent abrasion and wear durability to the lower midsole.

In even a further embodiment, the outsole can include outsole indentations or grooves generally vertically aligned with the indentations of the plate, as well as the upper and lower voids of the respective upper midsole and lower midsole. The outsole indentations or grooves can be located between the individual pillars as well to provide increased flexibility, articulation, dynamic movement and proprioceptive feedback via the sole assembly.

In a further embodiment, the pillars and the respective upper and lower voids above and below the plate between pillars can be selectively located in the sole assembly. For example, the pillars and voids can be disposed in the heel region to provide customized cushioning in the heel. In some cases, the pillars and voids can terminate forward of the heel region, in the arch or forefoot regions. The plate also can terminate in these regions, with the upper midsole transitioning to a deeper depth beyond the plate and/or pillars, so that the sole assembly includes only the upper midsole above the outsole in the forefoot, with the upper midsole, plate and lower midsole being located in the heel.

In still a further embodiment, the upper midsole and lower midsole can be constructed from different materials. In some cases, the upper midsole and lower midsole can be constructed from super critical foam (SCF). The SCF of the upper and lower midsoles can have different densities, cell size air content, additives or other characteristics. In other cases, one of the upper and lower midsoles can be constructed from SCF, while the other can be constructed from EVA (ethyl vinyl acetate), TPU (thermoplastic polyurethane), PE (polyethylene), SBR (styrene butadiene rubber), PU (polyurethane), PEBA (polyether block amide) to provide different reactivity and dynamic response above and below the plate.

In yet a further embodiment, the upper midsole and lower midsole can be constructed with different durometers and/or to include cores of different durometers than a surrounding shell or midsole sidewall. In some cases, the upper midsole can have a first durometer hardness and the lower midsole can have a second, different durometer hardness. The first durometer hardness can be greater than, equal to or less than the second durometer hardness.

In even a further embodiment, the plate can be contoured or can have structure to provide rigidity, focused flexibility, and to control the cushioning or energy efficiency of the sole assembly. For example, the plate can include a flare or wedge around its outer edge to engage the respective upper pillars and lower pillars. This can provide stability to the pillars and control their compression and shear force reaction. As a further example, the plate can include slots to provide lateral flexibility yet still provide the energy return and traction offered by the plate. As yet another example, the plate can include ribs, ridges or I-beams to improve rigidity in one or more directions along or transverse to the plate and sole assembly.

The current embodiments provide a sole assembly that provides exceptional cushioning, stability and energy return. Where included, the voids between the respective pillars and plate, for example in the heel, can collapse and compress, providing an enhanced cushioning and impact absorption. Where included, the plate, voids and heel to toe drop can provide forward momentum for a user while hiking, trail running, walking or performing other activities. This can enhance the user's speed and gait, and can offer some benefits in competition as well as personal achievements. Where included, the branding bridge can provide a unique opportunity to provide information or branding along the plate, in a recessed area of the sole assembly not previously available and visible from an upper perspective view of footwear. Where included, the undulating plate can provide a user with a foot cradling effect and improved arch support, coupled with enhanced stability.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
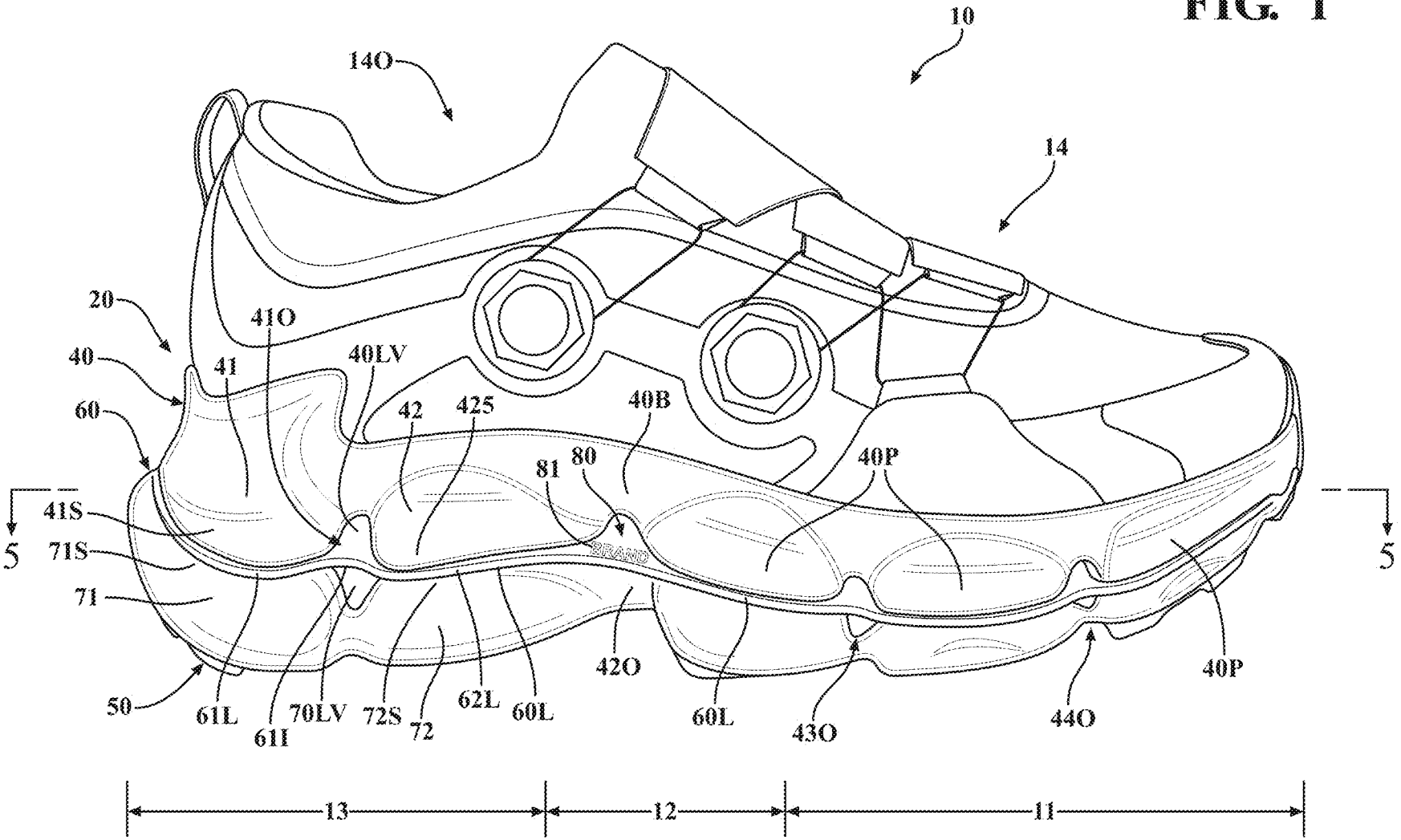
FIG. 1 is a side view of an article of footwear incorporating a sole assembly according to current embodiment.

A footwear construction of a current embodiment is shown in FIGS. 1-5 and generally designated 10. The footwear 10 can include a sole assembly 20 that incorporates a primary or upper midsole 40, a plate 60 and a secondary or lower midsole 70. The sole assembly 20 can include an outsole 50 that is joined to a lower surface of the secondary midsole 70. The upper midsole 40 and lower midsole 70 can include respective pillars extending toward one another and vertically aligned with one another above and below the plate 60. For example, the upper midsole 40 can include a first upper pillar 41 on a lateral side L of the longitudinal axis LA, a second upper pillar 42 disposed forward of the first upper pillar 41 on the lateral side L and separated from the first upper pillar 41 by an upper lateral void 40LV that extends toward the longitudinal axis. The upper midsole also can include a third upper pillar 43 disposed on a medial side M of the longitudinal axis LA, and a fourth upper pillar 44 disposed forward of the third upper pillar 43 on the medial side M and separated from the third upper pillar 43 by an upper medial void 40MV that extends toward the longitudinal axis. The lateral void and medial void can be connected and continuous to form a cavity, compartment or first upper void or upper opening 41O that extends transversely through the width W of the sole assembly 20 from the lateral side L to the medial side M.

The lower midsole 70 can include an upper or top surface 70U that faces toward the first upper pillar 41, the second upper pillar 42, the third upper pillar 43 and the fourth upper pillar 44, and an opposing lower or bottom surface 70L. The lower midsole can include pillars that are vertically aligned with the upper pillars, for example, a first lower pillar 71 on the lateral side L, a second lower pillar 72 disposed forward of the first lower pillar 71 on the lateral side L and separated from the first lower pillar by a lower lateral void 70LV that extends toward the longitudinal axis. The lower lateral void 70LV can be vertically aligned with the upper lateral void 40LV. The lower midsole 70 can include a third lower pillar 73 disposed on a medial side M, and a fourth lower pillar 44 disposed forward of the third lower pillar 73 on the medial side M and separated from the third lower pillar 73 by a lower medial void 70MV that extends toward the longitudinal axis LA. The lower medial void 70MV can be vertically aligned with the upper medial void 40MV.

Figure 2:
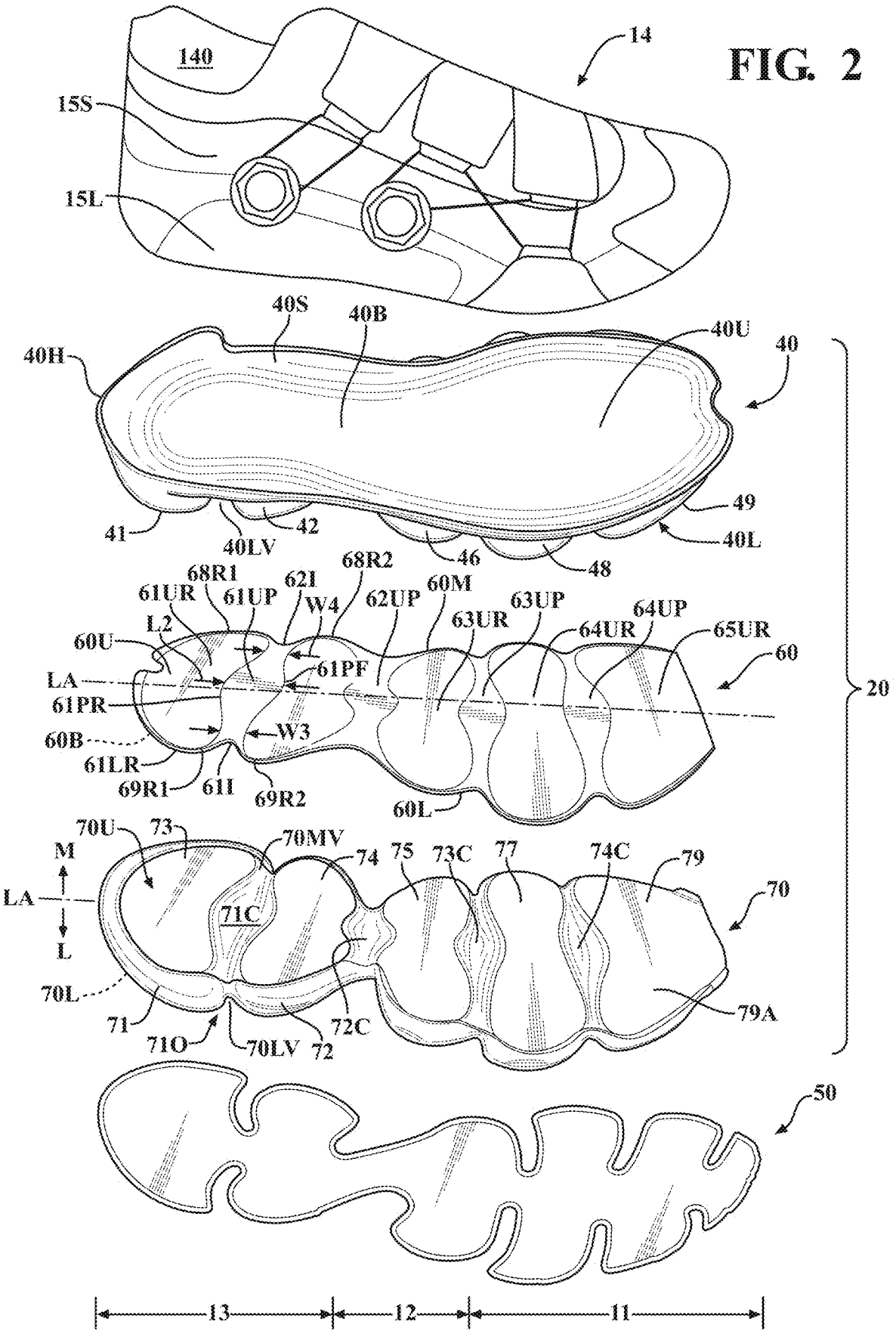
FIG. 2 is an upper perspective exploded view of the footwear with the various components of the sole assembly disassociated from one another.
Figure 3:
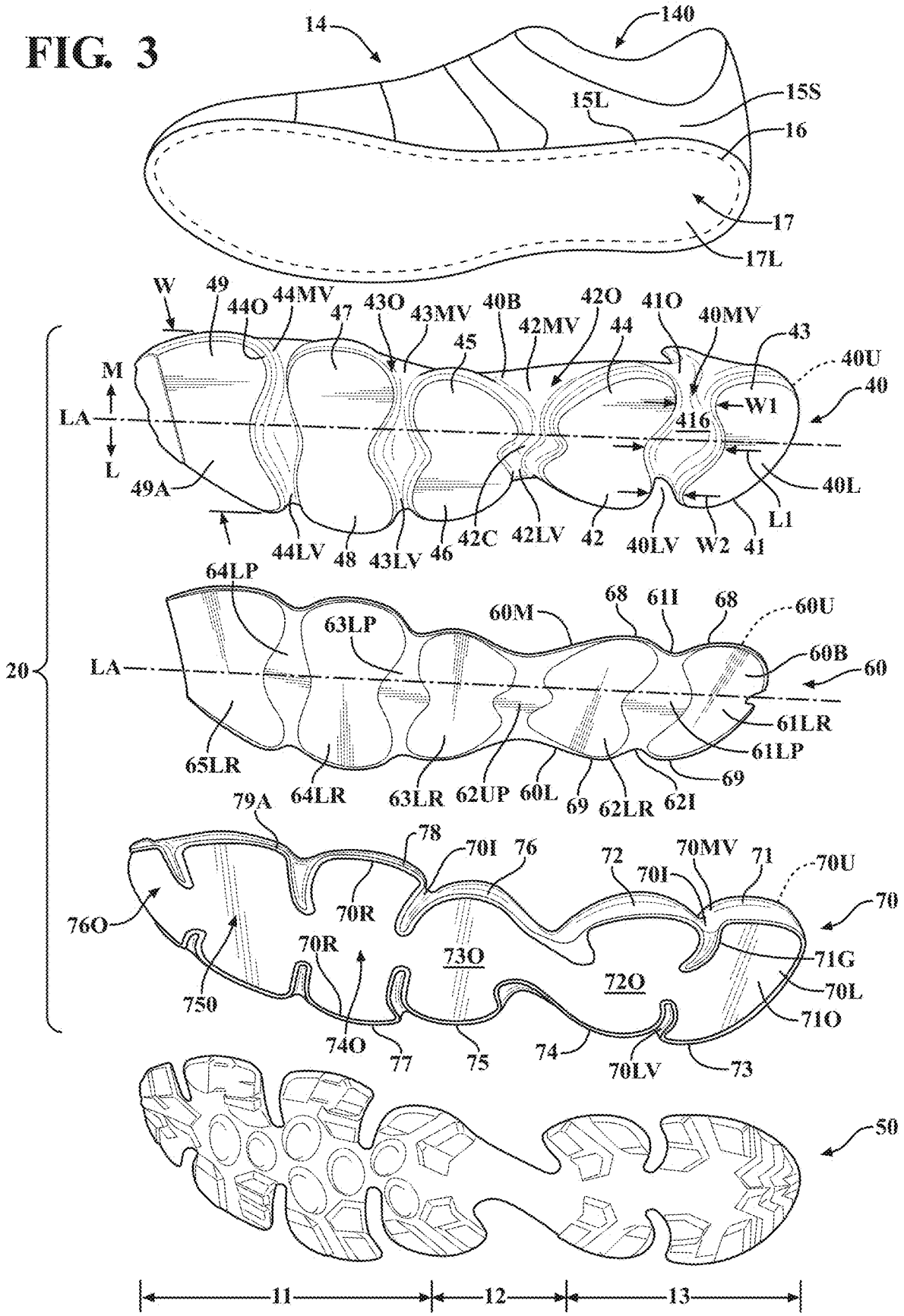
FIG. 3 is a lower perspective exploded view of the footwear with the various components of the sole assembly disassociated from one another.

The plate 60 can be sandwiched between the upper midsole 40 and the lower midsole 70 as shown in FIGS. 1-3. The plate can include a lateral plate edge 60L and a medial plate edge 60M. The plate can include a plate upper surface 60U and a plate lower surface 60B. The plate 60 can extend between the first upper pillar 41 and the second upper pillar 42, and can separate the upper lateral void 40LV from the lower lateral void 70LV, and likewise the upper medial void 40MV from the lower medial void 70MV. The plate upper surface 60U can face upward toward the upper lateral void and upper medial void, and the plate lower surface 60B can face downward toward the lower lateral void and lower medial void.

Although a current embodiment is illustrated in the context of a hiking or trail running shoe, the sole assembly thereof can be incorporated into any type or style of footwear, including performance shoes, running shoes and boots, work boots, all-terrain shoes, hiking boots, athletic shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe.

Figure 4:
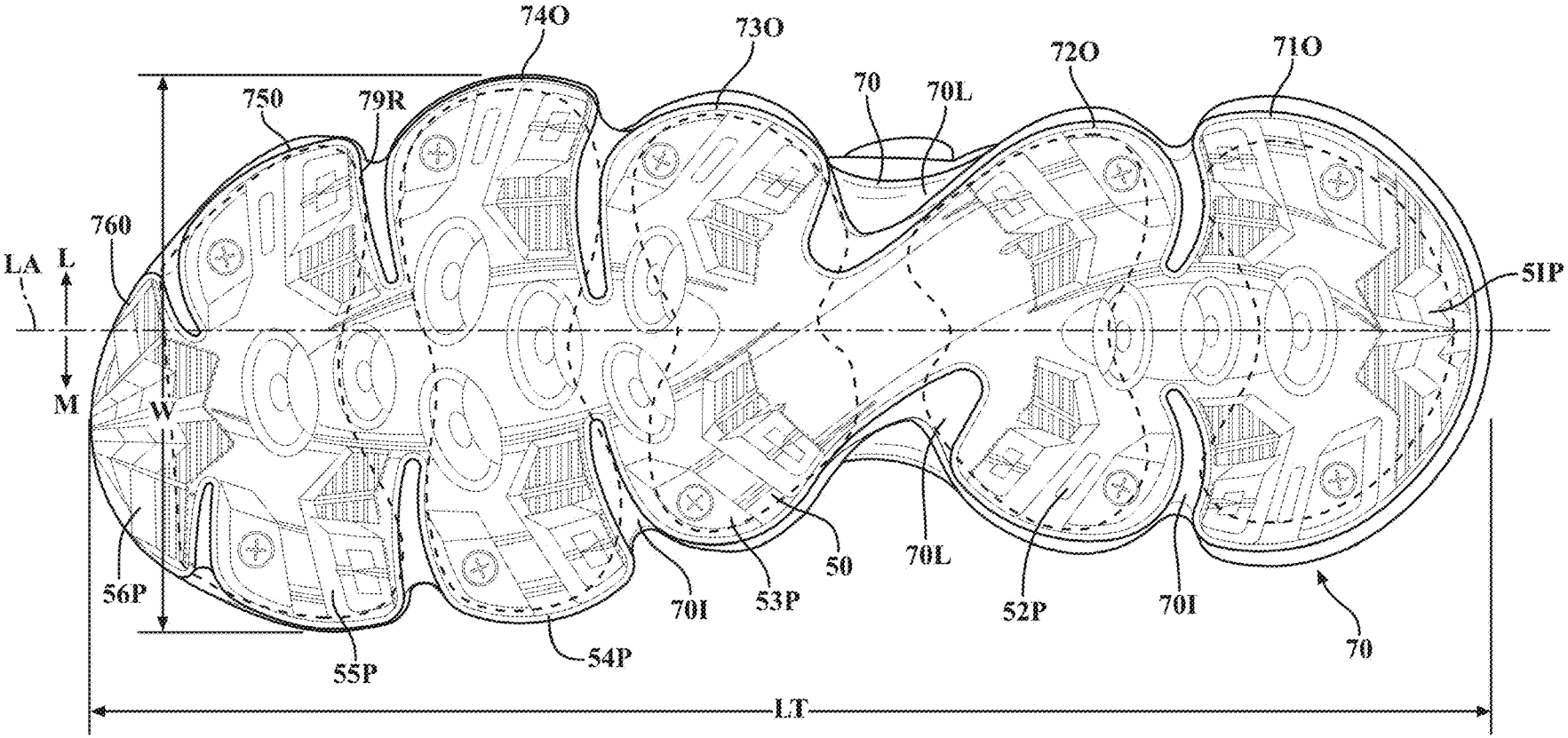
FIG. 4 is a lower view of the sole assembly.

The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 11, arch region or mid-foot region 12, and heel region 13 generally are identified in FIG. 1; however, delineation of these regions may vary depending upon the configuration of the sole assembly and/or footwear. Further, the footwear and sole assembly can include a longitudinal axis LA that generally bisects the same into lateral and medial portions on lateral L and medial M sides of the axis LA, as well as a length LT and a width W along the length, as shown in FIG. 4.

The footwear 10 can include an upper 14 joined with the sole assembly 20. The upper 14 can be formed from a variety of material elements joined together to cover at least a portion of the wearer's foot. The material elements can be selected based on the intended uses of the article of footwear 10, and can include synthetic textiles, mesh textiles, silicone, rubber, polymers or leather, for example. The upper 14 can be constructed to improve the rigidity of the sole assembly 20. For example, the upper can be constructed from leather, plastic, canvas or other materials. The upper 14 can include one or more closure elements, including, for example, shoelaces or corded closure systems that are operated via one or more dials. The upper 14 can include an upper opening 14O for receiving the wearer's foot.

The upper 14 can be secured to sole assembly 20 using any form of attachment. Optionally, the upper 14 can extend downward along an upper sidewall 15S to a lower portion 15L including a lower perimeter or allowance 16. This allowance can be secured to an insole or Strobel board 17 via stitching, adhesives or other connecting techniques. The lower portion 15L, sidewall 15S and/or allowance 16 of the upper 14 can be secured to the midsole 20 as described below via an adhesive. The lower surface 17L of the Strobel board can be secured to the sole assembly 20 and upper midsole 40 as described below. The joining of the sole assembly, midsole and the upper components can be accomplished using adhesives, cement, injection molding, pour molding or any other technique used to join an upper and sole assembly.

Figure 5:
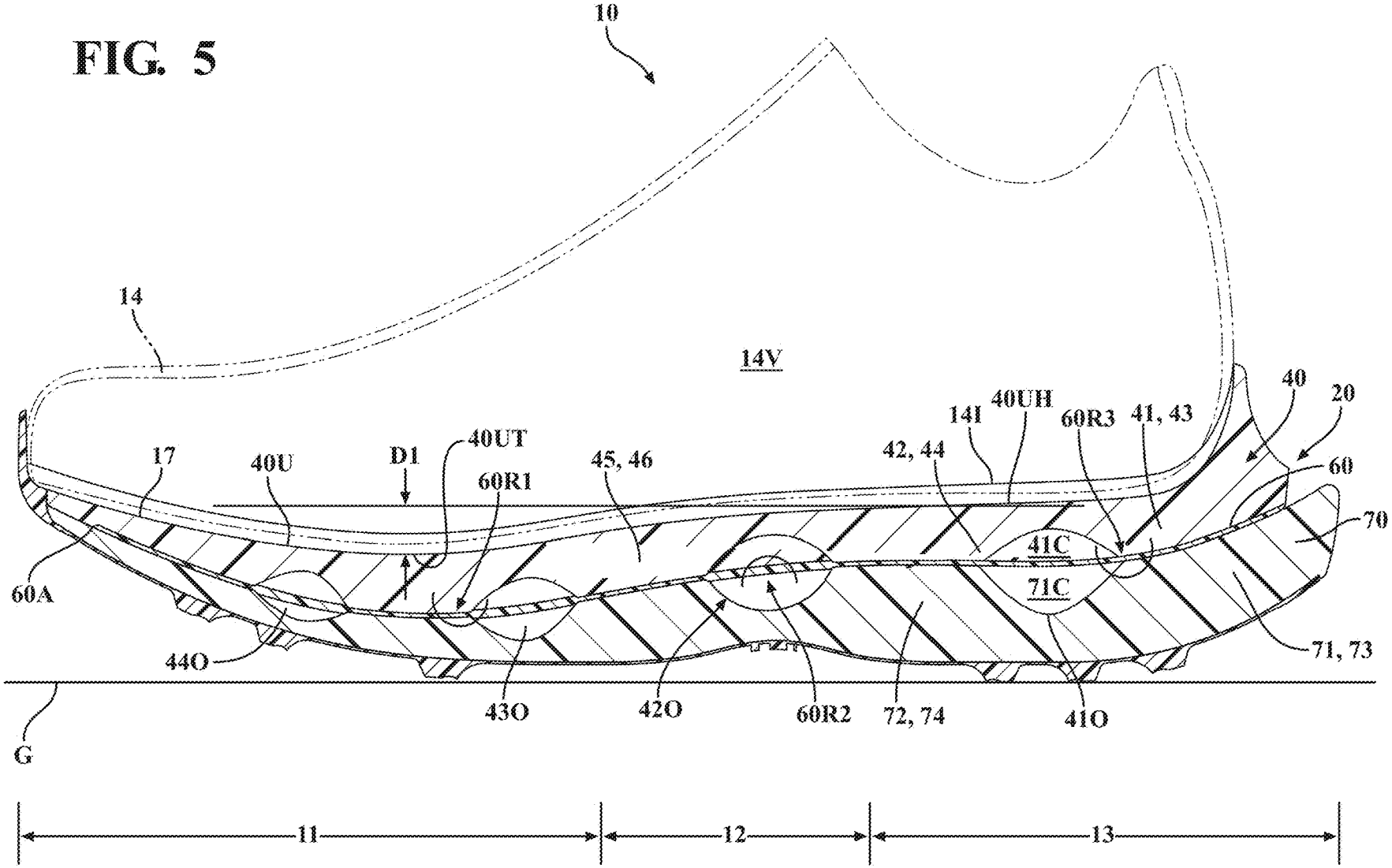
FIG. 5 is a section view of the sole assembly taken along lines 5-5 of FIG. 1.

As further shown in FIG. 5, the footwear 10 can include an inner sole or footbed 14I positioned within the void 14V defined by the upper 14. The insole 14I can be constructed from a sheet of material, such as foam, EVA, PU, latex, gel or other materials, and by virtue of its compressibility, provide cushioning, and may also conform to the foot in order to provide comfort, support, and stability. The footbed 14I need not be constructed from a sheet material, but may instead be formed by other techniques, such as injection molding, compression molding or additive manufacturing. The footbed can be disposed above the upper surface 17U of the Strobel board, in the void 14V defined by the upper 14, and generally does not form part of the midsole or the sole assembly 20.

The sole assembly 20 will now be described in further detail with reference to FIGS. 1-5. The sole assembly 20 of the illustrated embodiment can include a primary midsole 40, a secondary midsole 70 with a plate 60 sandwiched therebetween, and an outsole 50, as perhaps best shown in FIGS. 3-4. Although shown herein, the plate and one of the midsoles can in some cases be absent from the construction. As mentioned above, the upper midsole 40 can be configured for securement between the upper 14 and the plate 60. The upper midsole 40 can include an upper midsole surface 40U and a lower midsole surface 40L opposite one another. The upper midsole surface 40U can form a portion of a base 40B that extends throughout the length LT of the footwear, generally through the forefoot region 11, arch region 12 and heel region 13. The base 40B can include upward extending sidewalls 40S that extend around a portion of the upper surface 40U. The upper surface 40U can form an upper force bearing surface of the sole assembly and/or the upper midsole, and can be that surface of the sole assembly against which a user's foot transfers force directly through or to as the user engages in activity with the footwear. The upper surface or upper force bearing surface 40U can be configured to be placed adjacent and joined with the Strobel board 17 or some other portion of the upper 14. The side wall 40S can be configured to extend upwardly along the lower portion 15L and/or the sidewalls 15S of the upper 14. The sidewall 40S of the upper midsole further can include a heel sidewall 40H that extends around the heel portion of the upper 14 and can effectively form a heel cradle there. Given the optional engagement or securement of the Strobel board 17 against or to the upper surface 40U of the base 40B and of the upper midsole 40 in general, the Strobel board 17 and upper surface 40U can follow common contours and can be disposed at similar elevations and likewise can change in elevation from the heel region 13 of the forefoot region 11 as described below.

As shown in FIG. 5, the sole assembly 20 and in particular the upper midsole 40 can include a predetermined and/or customized heel to toe drop wherein a heel top surface 40UH of the sole assembly is elevated a distance D1 above a forefoot top surface 40UT of the sole assembly. The heel to toe drop distance D1 can be measured as a vertical distance (e.g., along the direction of gravity) when the footwear 10 or sole assembly 20 is on a horizontal surface G the ground. The distance D1 can be located between a heel top surface location 40UH, which generally receives and supports a user's calcaneus bone, and a forefoot top surface location 40UT, which generally receives and supports a user's metatarsal-phalanges joints. In other words, the heel-to-toe drop D1 can be a measure of a height difference between a heel bottom and a forefoot bottom of a foot donning the footwear 10. Where an insole or footbed 14I is included, that insole or footbed likewise can reflect the heel to toe drop and contours of the upper surface 40U elevation difference D1 from heel to toe.

As shown in FIG. 5, the upper force bearing surface or top surface 40U of the midsole 40 and sole assembly 20 can gradually transition between the heel top surface location 40UH and the forefoot top surface location 40UT to accommodate a natural fit via an arcuate contour for a user's foot. To provide a particular heel to toe drop geometry of the sole assembly 20, the plate 60 and/or lower midsole 70 can follow the general contours of the upper surface 40U of the upper midsole 40.

The upper midsole or sole assembly can be configured to provide a particular heel to toe drop or distance D1 that accommodates various hiking or trail running styles. The heel to toe drop can be optionally at least 8 mm, at least 10 mm, at least 12 mm, at least 14 mm, 8 mm to 14 mm, inclusive, 8 mm to 12 mm, inclusive, or 10 mm to 12 mm, inclusive, or other distances D1 depending on the application. Further optionally, when in the higher range of these heel drops, the footwear can feel more like a logger or hiking boot, and in combination with the upper and lower midsoles plus plate in some cases, can propel a user into their next stride, thereby effectively providing forward momentum via the footwear on a trail or over terrain. Even further optionally, a heel to toe drop of about 8 mm to about 12 mm, inclusive, or 10 mm to 12 mm inclusive, can place the user's legs in a relatively more coiled position, allowing the runner's legs to receive ground strike forces like a spring and then rebound to propel the runner forward.

With reference to FIGS. 1-4, the upper midsole 40 can include a plurality of pillars 40P, which can be joined with and can extend downwardly from the base 40B of the upper midsole 40. These pillars can come in a variety of shapes and configurations which will be briefly described here. As shown, the pillars can include the first pillar 41, a second pillar 42 forward of the first pillar with a lateral void 40LV disposed between those pillars and extending into an internal cavity or compartment 41C. The pillars 41 and 42 can generally be located on the lateral side L of the longitudinal axis LA. On the opposite side or the medial side M of the longitudinal axis LA, third 43 and fourth 44 pillars can be located and separated by a medial void 40MV. This void 40MV can transition to and can be contiguous with the internal compartment 41C which again can be contiguous with the lateral void 40LV. The medial void 40MV, central compartment 41C and lateral void 40LB can extend across the width W of the upper midsole 40 and can extend transversely relative to the longitudinal axis LA. This combination of compartments and voids can form a continuous upper opening or upper void 41O that extends transversely through the upper midsole from one side to the other so that a user can view completely through the upper midsole through this combination of voids and the compartment. As described below, this first upper opening or upper void 41O also extends from the lateral side to the medial side, above the plate 60 and its upper surface 60U.

Figure 6:
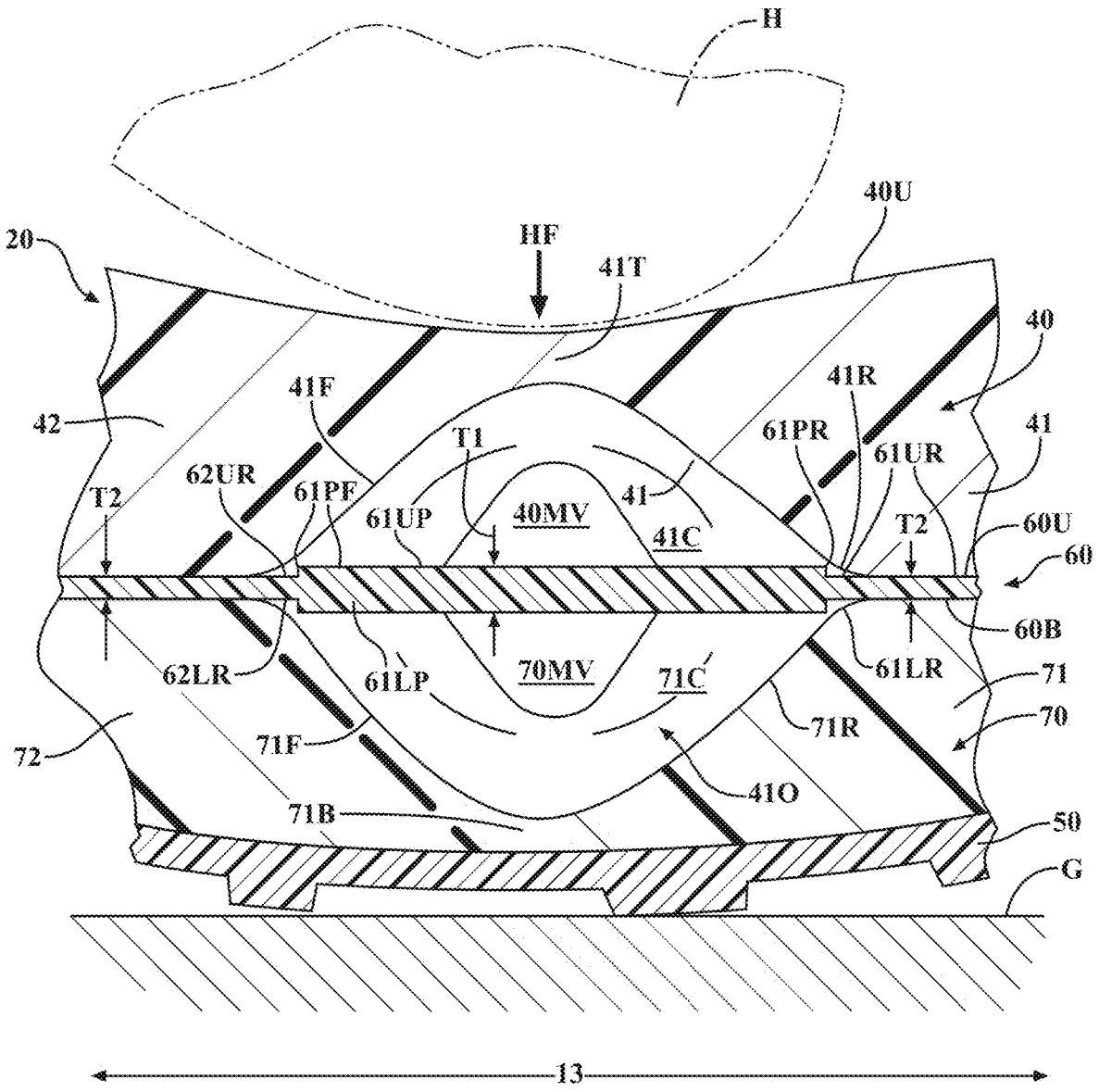
FIG. 6 is a close-up section view of a compression void of the sole assembly in an uncompressed mode.

The pillars 41, 42, 43 and 44 are shown located in the heel region 13 of the footwear 10. These and any other pillars optionally can be in the form of irregular shaped bulges that extend downward from the base 40B toward the lower surface 40L of the upper midsole 40 again as shown in FIGS. 4-5. The pillars can take on a variety of other shapes and in some cases can be cylindrical, in other cases spherical, and yet other cases polygonal. Further optionally, the pillars on the lateral and medial sides can be joined with one another as shown, for example, in FIG. 4. There, the first pillar 41 and third pillar 43 are disposed at the rearward most part of the heel region 13. These first and third pillars can be constructed from the same material and continuous with one another, without any separation or spacing being disposed between the first pillar 41 and the third pillar 43. The first pillar 41 and third pillar 43 can effectively be continuous with one another and combined to form a rearward wall 41R of the compartment 41C as shown in FIG. 6. That rearward wall 41R can form the boundary of the compartment 41C and can further form the rearward-most boundary, wall, or perimeter of the respective upper medial void 40MV and upper lateral void 40LV which can form a portion of the first upper opening 41O.

Optionally, like the first pillar and the third pillar, the second pillar 42 and fourth pillar 44 can be contiguous with one another and can be formed from the same material as the remainder of the upper midsole 40. These pillars 43 and 44 can form a forward wall 41F that bounds or forms a perimeter of the first compartment 41C forward of that compartment. This forward wall 41F can extend out and to the upper medial void 40MV and the upper lateral void 40LV between the respective pillars in the heel region 13. Further optionally, the forward wall 41F and the rearward wall 41R can transition to one another along an upper wall, ceiling or roof 41T of the first opening or void 41O, or generally of any one or more of the lateral void 40LV, the medial void 40MV and/or the compartment 41C. The compartment 41C can open near the longitudinal axis. There, the compartment can include a length or dimension L1 that is greater than the respective widths W1 and W2 of the respective upper voids 40MV and lower voids 40LV. These respective widths W1, W2 and the length L1 can be taken along lines that are generally parallel to the longitudinal axis LA of the sole assembly and the upper midsole 40.

As mentioned above, the pillars optionally can extend forward, into the arch region 12 and forefoot region 11. Additional pillars can be included in the sole assembly, such as a fifth pillar 45 and a sixth pillar 46 disposed on the medial and lateral sides of the longitudinal axis LA. These fifth 45 and sixth 46 pillars can generally mirror the shapes and forms of the second 42 and fourth 44 pillars in the heel region. This set of pillars, that is, the second pillar 42, fourth pillar 44, fifth pillar 45 and sixth pillar 46 can cooperatively form the respective second lateral void 42LV and second medial void 42MV on opposite sides of the longitudinal axis LA. These voids can be contiguous with and connected via a second internal compartment 42C such that the voids and compartment can form a continuous upper opening 42O from the lateral side L transversely to the medial side M across the width of the upper midsole. Further optionally, although referred to as first, second, third, fourth, etc. pillars, voids or compartments, the components can be interchangeably referred to herein.

As shown in FIGS. 4 and 5, the upper pillars can further include an additional seventh pillar 47 and eighth pillar 48, a ninth pillar 49 and a tenth pillar 49A. These pillars can be separated by respective lateral and medial voids 43LV, 43MV as well as 44LV and 44MV, which can be contiguous with and can extend through the upper midsole with respective compartments 43C and 44C to form additional openings 43O and 44O that extend transversely through the upper midsole 40. Of course, additional sets of pillars, voids or internal compartments can be added to the upper midsole depending on the application, and the structure or function of the upper midsole and sole assembly in general.

As mentioned above, and with reference to FIGS. 1-4, the sole assembly can include a secondary or lower midsole 70. This lower midsole 70 as mentioned above can include a first lower pillar 71, a second lower pillar 72 forward of that first lower pillar 71 on the lateral L side of the longitudinal axis. The first lower pillar 71 can be disposed below and vertically aligned with the first upper pillar 41, and the second lower pillar 72 can be disposed below and vertically aligned with the second upper pillar 42. Optionally, the upper and lower pillars of each respective similar number can be aligned one above the other to transfer vertical loads from the user, to the upper midsole upper pillars, through the plate, into the corresponding underlying pillars in the lower midsole and ultimately to the outsole 50 and ground. The transfer of certain forces during a stride or gait in hiking or trail running, or other activities, primarily can be linear and vertical. Due to the expanding and bulging reactive properties of the respective pillars when subjected to vertical forces, some of those vertical forces can be dissipated into horizontal and/or shearing forces that extend and project outwardly away from the axis LA and toward the respective edges of the plate 60 as described below.

Similarly, as shown in FIGS. 2-5, the third lower pillar 73 and fourth lower pillar 74 on the medial side M can be disposed below the plate, and vertically aligned with the third upper pillar 43 and the fourth upper pillar 44. The alignment of these third and fourth pillars above and below the plate can allow the transfer of forces from the upper pillars to the lower pillars in a manner similar to that described above in connection with the first and second upper and lower pillars on the lateral side of the sole assembly 20.

As shown in FIG. 2, the pillars on the respective lateral and medial sides can be separated by respective lower medial void 70MV and lower lateral void 70LV. These lateral and medial voids can be connected to a first lower compartment 71C that is disposed in the heel region 13 of the sole assembly to form a first lower transverse opening 71O below the plate 60. This transverse first lower opening 71O can extend through the lower midsole 70 such that a viewer can view completely through the lower midsole 70, below the plate 60 through that opening from the lateral side L to the medial side M. This lower opening 71O can be aligned with the upper opening 41O, but below the plate instead of above the plate. As further shown in FIGS. 5 and 6, the first lower compartment 71C can be disposed directly below the first upper compartment 41C, under the plate. The first lower compartment 71C can transition to and can be contiguous with the lower medial void 70MV and the lower lateral void 70LV. The respective voids and compartment can be bounded by a forward wall 71F that extends across and forms a portion of the second lower pillar 72 and the fourth lower pillar 74. A rearward wall 71R can bound the respective voids and compartment, can extend across and can be contiguous with the first 71 and third 73 lower pillars. In some applications, the respective front walls 41F, 71F and rear walls 71R and 41R can be discontinuous, where the respective pillars are themselves separated from one another by a distance and not contiguous with one another.

Optionally, the compartment 71C and voids can transition to a lower or bottom wall 71B that can extend throughout or under all these elements. In some applications, where the lower voids 70MV and 70LV transition directly to the outsole 50, that lower wall might not be present in those locations. Further, in some alternative constructions, the bottom wall 71B can be entirely absent, in which case the compartment 71C and the voids 70MV and 70LV can open directly to the outsole 50 across all or a portion of the lower portion of the lower midsole 70.

Optionally, the lateral and medial voids as well as the respective compartments or cavities in the heel region 13, or any other regions, can provide a certain cushioning and impact absorption functionality. As mentioned above, the upper lateral void 40LV can transition to the first upper compartment 41C, which also can be referred to as an upper heel cavity when disposed in the heel region 13. The upper heel cavity 41C can further transition to the upper medial void 40MV. These cavities and voids can be disposed above the plate 60 when included. Likewise, the lower lateral void 70LV can transition to the first lower compartment 71C, which can be referred to as the lower heel cavity, when also disposed in the heel region 13. The lower heel cavity 71C can further transition to the lower medial void 70MV. These cavities and voids can be disposed below the plate 60 when included.

Figure 7:
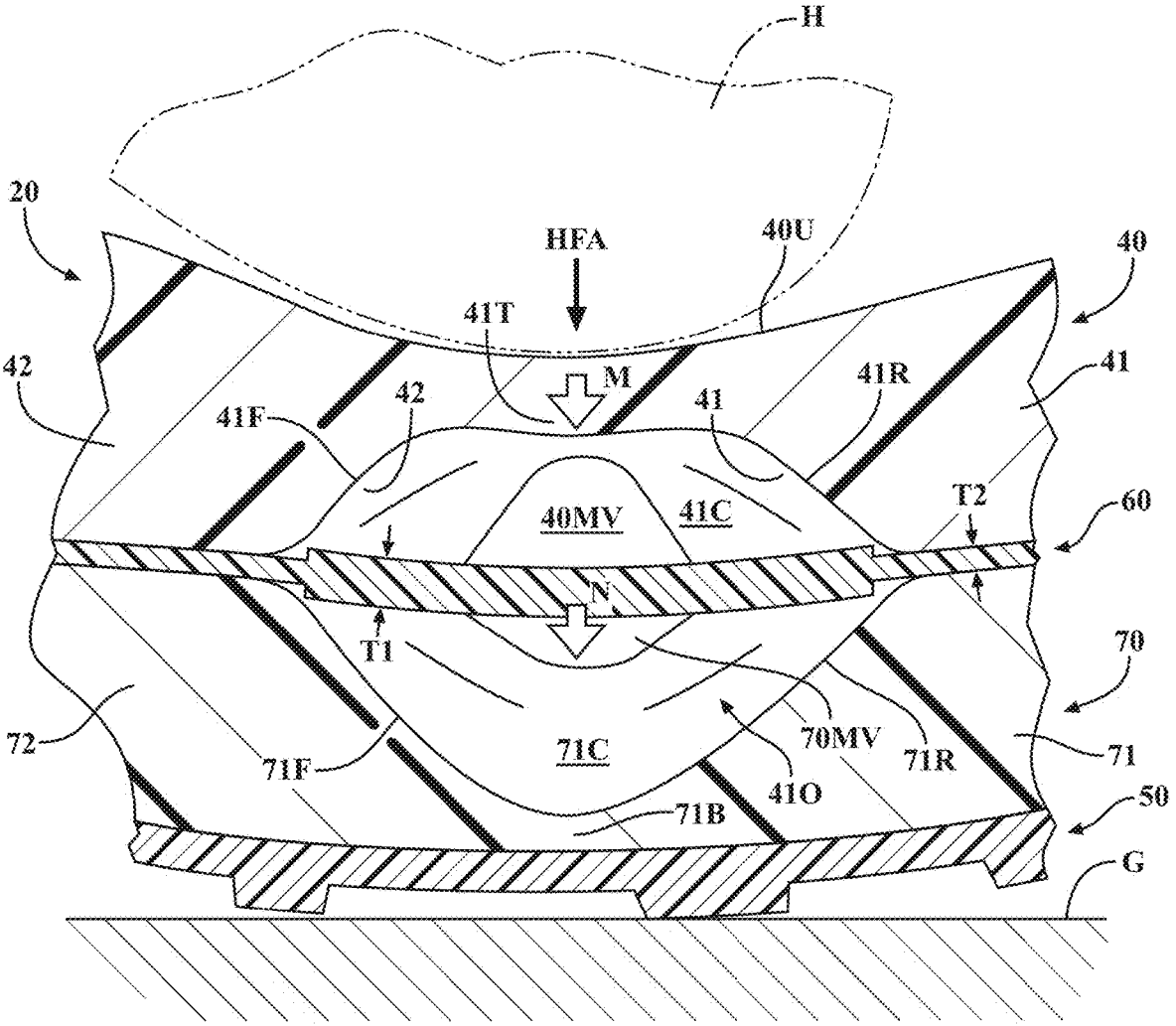
FIG. 7 is a close-up section view of the compression void of the sole assembly in a compressed mode or collapsed mode under load.

As shown in FIGS. 6 and 7, these cavities and voids can be disposed below a heel H of a user when the footwear 10 is worn by a user. FIG. 6 illustrates the heel of a user exerting a heel force HF on the upper wall or top wall 41T that extends over the compartments 41C and 71C, as well as the upper and lower lateral and medial voids. The heel force HF can be produced by the normal weight of the user through the heel H of the user when the user is standing or stationary. The compartments 41C and 71C are generally open and the upper wall 41T of the upper midsole 40 has an arched or domed shape, optionally slightly parabolic. When a user engages in an activity, such as hiking or trail running or some other activity, upon heel strike, the user's heel will exert a greater heel force HFA through the sole assembly 20, in which case, the upper 40 and lower 70 midsole components and respective cavities, compartments and voids come into play. As shown in FIG. 7, when a user's heel exerts the greater heel force HFA (which is greater than a stationary heel force HF) on the sole assembly 20, that greater force HFA translates to the upper midsole 40 to translate the sole assembly to a compressed or collapsed mode in that area. As a result, the upper midsole wall 41T can partially deform or collapse downward in direction M into the first upper cavity 41C.

The force HFA then can dissipate through the first upper pillar 41 through the plate 60 into the first lower pillar 71 to the outsole 50 and ultimately to the ground G. Likewise, forward of the compartment 41C and the voids, the force HFA translates through the upper wall 41T of cavity, through the second upper pillar 42 and the second lower pillar 72 to the outsole 50 and ultimately to the ground G. As this occurs, the plate 60 can flex downward slightly in direction N within the compartment 41C or generally into the opening 71C. The plate 60 also can flex or move toward the bottom wall 71B within the first lower compartment 71C. As this occurs, again the plate can move in direction N toward that bottom wall 71B. When constructed from a softer or less dense material, the upper and lower pillars can bulge or expand in width, but can decrease in height, to allow the plate to transition downward toward that lower or bottom wall 71B.

As the force HFA is transferred through the plate and to the lower pillars of the lower midsole 70 surrounding the compartment 41C, due to heel strike or other significant impact of the heel with the ground, the force HFA can be dissipated through and absorbed by the respective upper and lower pillars and portions of the plate before transferring to the ground G under foot. The dissipation of the force via the deformation of the walls and pillars of the upper midsole 40 and lower midsole 70 likewise provides impact attenuation and energy absorption. The respective first, second, third and fourth upper pillars as well as the first, second, third and fourth lower pillars also optionally can bulge and deform to absorb the impact force HFA on the sole assembly. This in turn can dissipate that force optionally through the portion of the plate. The positioning of the plate 60 between the upper and lower pillars also can insulate the upper and lower pillars from a direct force translation, and can dynamically redistribute the force HFA from the heel, forward and optionally beyond the second and fourth upper and lower pillars. As a result, this can in some cases dissipate that force forwardly to the additional upper pillars 45, 46 and the corresponding lower pillars 75, 76 and even to the farther forward pillars 47, 48 and 77, 78 under the plate 60.

After the greater force HFA from the heel H is removed from the sole assembly 20, the pillars, compartment and voids in the heel region and elsewhere can return to the uncompressed mode shown in FIG. 6. As the different portions of the foot engage the sole assembly 20 through the upper surface 40U of the upper midsole 40, similar deformations can occur in the pillars, compartments and voids in the arch region 12 and in the forefoot region 13. As an example, the more forward compartments 42C, 43C and 44C can have their respective upper walls collapsed downward into those compartments and the respective lateral and medial voids. The respective upper pillars, for example 45-49A likewise can partially collapse, compress, deform, decrease in height and/or bulge outward on the respective medial and lateral sides. The forces can be translated through the plate 60 to the respective lower pillars 75-79A which also can collapse, compress, deform, decrease in height and/or bulge upon receiving those forces which can further be transferred through the sole 50 ultimately to the ground G. As with the above upper compartments 42C, 43C and 44C, the corresponding lower compartments 72C, 73C and 74C likewise can deform or change in shape, with the plate 60 moving downward at least partially in those compartments toward the respective bottom or lower wall in the compressed mode.

Optionally, the lower surface 70L of the lower midsole 70 as shown in FIG. 3 can include one or more recesses 71O, 72O, 73O, 74O, 75O and 76O that correspond to each of the respective sets of pillars. For example, the recess 71O can correspond to the lower pillars 71 and 73 that extend above that recess. The second lower recess 72O can correspond to the lower pillars 72 and 74 that extend above that recess. These lower surface recesses 71O, 72O, for example, also can include flexural grooves 71G, for example, that can be aligned with the perspective lower lateral 70LV and lower medial 70MV voids on opposing sides of the lower midsole. Additional flexural grooves in the arch region and forefoot region can likewise correspond to lower lateral and medial grooves between respective sets of pillars on the lateral and medial sides of the sole assembly.

The lower surface 70ML of the lower midsole optionally can include a perimeter rim 70R that can extend around and form a boundary or perimeter about each of the respective recesses 71O-76O. The rim 70R also can extend around or define flex grooves 71G corresponding to the lateral and medial lower voids in the lower midsole 70. These flex grooves 71G and the rim 70R surrounding them can align with the indentations of the plate and with the lateral and medial sides of the plates. The recesses and rim can engage, orient and secure the outsole 50. For example, as shown in FIG. 4, the outsole can include tread pods 51P, 52P, 53P, 54P, 55P and 56P that each fit in the respective recesses 71O, 72O, 73O, 74O, 75O and 76O on the lower surface 70L of the lower midsole 70. The rim 70R can extend generally around the outer periphery of the outsole in these locations and can help locate and orient the outsole tread pods relative to the lower midsole 70. The outsole 50 can be cemented, adhered molded or otherwise attached to the lower surface 70L of the lower midsole 70. The outsole can include lugs, treads, siping, microlugs, grooves, recesses or other traction enhancing features on the lower surface thereof.

The upper 40 and lower 70 midsoles can be constructed from a variety materials. For example, the midsoles can be constructed from open or closed cell foams. In some cases, one or both midsoles can be constructed from super critical foam (SCF), EVA (ethyl vinyl acetate), TPU (thermoplastic polyurethane), PE (polyethylene), SBR (styrene butadiene rubber), PU (polyurethane), Latex and/or Neoprene. The materials can also be mixed and matched, for example, with the upper midsole made from one of the above materials, and the lower midsole constructed from another of the above materials. Further optionally, the midsoles can be constructed to include a first durometer hardness, referred to as first durometer herein. This first durometer can be optionally 45 Asker C to 65 Asker C, inclusive, 50 Asker C to 70 Asker C, inclusive, 50 Asker C to 65 Asker C, inclusive, 50 Asker C to 60 Asker C, inclusive, or about 45 Asker C to about 50 Asker C inclusive. The hardness or durometer of any materials described herein as a particular type Asker C can be measured via ASTM D2240 standard, which is hereby incorporated by reference in its entirety. The upper midsole 40 and lower midsole 70 can include different hardness or durometers taken from the above or other ranges.

When optionally constructed from a supercritical foam SCF, the midsoles can include different durometers, different aesthetic appearances with colorants, and can have different regions having different durometers therein, as disclosed in co-pending U.S. patent application Ser. No. 18/139,773, filed on Apr. 26, 2023, and entitled "Sole Assembly and Related Method of Manufacture", which is hereby incorporated by reference in its entirety.

As mentioned above, the sole assembly 20 optionally can include a plate 60. The plate and its components will now be described in further detail. The plate can extend from the forefoot region toward the heel region, optionally through the arch region. This plate can be constructed from carbon fibers and/or a resin including certain polymers, composites, polymers, fiber reinforced polyamides, and/or combinations thereof. The plate can be suitably flexible, hard and/or rigid across the width W and along the length L of the sole assembly. The plate optionally can change in thickness and/or material composition along its length and/or transverse dimensions to effectively vary the flexibility, elastic and spring-like characteristics along different portions of the plate. Although shown as a full plate, the plate 60 can be a partial plate and can extend only part way across the width W and/or part way along the length L, for example, only in the forefoot region and/or the arch region or only in the heel region and arch region, or only in the arch region to act as a shank or arch support.

With reference to FIGS. 2, 3 and 6, the plate 60 can include an upper surface 60U and a lower surface 60L. The plate upper surface can include multiple recesses and ridges or raised portions that can assist in placement, orientation and/or engagement of the respective pillars. For example, as shown in FIG. 2, the upper surface 60U can include a first upper recess 61UR and a second upper recess 62UR. These surfaces can be recessed regions between which a projection, ridge or raised portion, all referred to as a projection, 61UP can be located. This projection 61UP can correspond generally to the outline of the upper midsole compartment 41C such that the forward 61PF shoulder of the projection 61UP can engage the forward walls 41F of the second 42 and fourth 44 upper pillars as shown in FIG. 6. By engaging the forward walls 41F of these pillars, the shoulder 61PF can assist in placement and precise orientation of those pillars 42 and 44 within the recess 62UR. Likewise, the rearward shoulder 61PR can engage the rearward wall 41R that extends rearward of the first upper cavity 41C and that forms the forward portions of the pillars 41 and 43. Via this engagement of the projection 61UP, the pillars 41, 42, 43 and 44 can be placed within the respective recesses 61UR and 62UR precisely. This can assist in placement of the plate between the upper midsole 40 and the lower midsole 70 and subsequent cementing, adhering or other securing of those upper and lower midsoles to the plate 60 as described below.

As shown in FIGS. 2 and 3, the upper surface 60U of the plate 60 can include specific projections and recesses that correspond to different sets of upper pillars. For example, the pillars 41 and 43 can be received by the upper plate recess 61UR, while the pillars 42 and 44 can be received in the upper plate recess 62UR. The pillars 45 and 46 can be received in the upper plate recess 63UR. The pillars 47 and 48 can be received in the upper plate recess 64UR. The pillars 49 and 49A can be received in the upper plate recess 65UR. Each of these respective sets of pillars can be separated by their respective ridges or projections 61UP, 62UP, 63UP and 64UP. These projections can align with and can be shaped similarly to the lowermost footprint of each of the respective upper pillars so that those pillars can be precisely placed relative to the plate and later secured relative thereto.

With further reference to FIGS. 2 and 3, the lower surface 60B of the plate 60 can include multiple lower recesses 61LR, 62LR, 63LR, 64LR and 65LR that are likewise separated by corresponding lower projections 61LP, 62LP, 63LP and 64LP as shown. This series of recesses and projections can receive and engage the respective lower pillars 71-79A therein. With this structure on the lower surface, the plate and lower midsole 70 can be placed precisely with regard to one another, with the respective pillars precisely aligned with the plate. In addition, the plate can function to precisely position respective upper and lower pillars vertically aligned with one another, over one another, or generally placed or oriented above one another in a particular orientation depending on the application. As an example in some cases, some upper pillars may be offset relative to lower pillars to providing different impact absorption, energy efficiency, cushioning and traction characteristics.

Turning to FIG. 6, the plate 60 can be configured with a particular construction of the recesses and projections. Although only showing the plate 60 between the upper midsole 40 and lower midsole 70 in the heel region, the plate 60 can be similarly constructed in different areas forward of the heel region 13 in connection with different pillars. As shown in FIG. 6, the first upper projection 61UP extending upward from the upper surface 60U of the plate 60 can be contiguous with and can lay directly over the first lower projection 61LP that extends from the lower surface 60B of the plate 60. In this region, the plate can be of a thickness T1. Optionally, in other constructions, the upper and lower ridges can be offset from one another and may not directly overlap one another to produce a combined thickness T1. In some cases, selected upper projections or selected lower projections can be deleted entirely from the upper and lower surfaces of the plate 60 depending on the application. As shown in FIG. 6, however, the projections 61UP and 61LP can provide a thickness T1 of the plate. This thickness optionally can follow the contours of the upper compartment 41C the lower compartment 71C, as well as the respective upper and lower lateral and medial voids. In some cases, the projection 61UP and 61LP can have a slightly smaller length L2 then the compartment length L1 as described above. Likewise, the width of the projection W3 can be slightly less than the width W2 of the lateral void 40LV. Similarly, the width W4 of the projection can be slightly less than the width W1 of the medial void 40MV. This again can be so that the respective pillars can fit within the respective recesses 61UR and 62UR, optionally between projections on the plate. The lower projection 61LP can have similar dimensions related to the lower compartment 71C and the respective widths of the voids 70LV and 70MV. The other projections along the plate likewise can have similar dimensions related to the respective compartments and voids.

With further reference to FIG. 6, the area of the plate 60 where the recesses, for example the upper 61UR and lower 61LR recesses, or the upper 62UR and lower 62LR recesses, are located, can be of a second thickness T2. This second thickness T2 can be less than the first thickness T1. This second thickness T2 can correspond to the respective recesses that engage and place the respective upper and lower pillars relative to the plate to provide alignment of the pillars relative to the recesses and vertically one above the other or in some other orientation relative to one another and the plate. The recesses can be disposed directly above and below the respective lower and upper pillars on the lateral and medial sides on the sole assembly 20. In the construction shown, the upper midsole upper pillars can be adhered or cemented to the upper surface 60U of the plate 60 within the respective recesses, for example, the upper recesses 61UR and 62UR. Likewise, the lower pillars, for example 71, 72, can be adhered to the lower surface 60B of the plate 60 within the respective lower recess 61LR and 62LR. In the regions where the pillars are cemented, adhered, bonded or otherwise joined with the lower surfaces of the respective pillars, that portion of the plate can be reinforced due to the attachment of the pillars there. Accordingly, in the thinner regions of the plate, for example, having the thickness T2 corresponding to the upper and lower recesses on the plate, when bonded to the pillars, those areas can be reinforced, and made more rigid are generally less prone to bending.

Optionally, the flexibility of the plate in the region of the recesses, due to the securement of the plate there to the pillars, can be brought close to or matched with the flexibility or bending resistance as the portions of the plate that include the projections and have the greater thickness T1. Thus, by having thicker portions of the plate with the thickness T1 within the voids and compartments of the midsole, and securing the pillars to the upper and lower surfaces of the plate in other regions with the lesser thickness T2, the plate 60 can include a generally uniform and consistent flexibility and/or rigidity to offer a certain level of stability from heel to toe, despite the different thicknesses of the plate. This in turn can translate to greater toe to heel, or side to side lateral stability and consistency throughout the plate and underfoot.

In general, the plate 60 can have varying thicknesses in different regions. The reduced thickness T2 can overlap with the respective upper and or lower pillars, while the greater thickness T1 can overlap and extend within the compartments and/or voids of the upper midsole 40 and lower midsole 70. Further optionally, the greater thicknesses T1 can be isolated to those regions of the plate 60 that extend within the open compartments and/or voids of the upper and lower midsoles.

Further optionally, as shown in FIGS. 2 and 3, the plate can include a rim that extends around and/or along a medial plate edge 60M or a lateral plate edge 60L of the plate 60. As shown in FIG. 2, the lateral edge 60L can include rim 69R1 and 69R2 that bound the lateral portions of the respective upper recess 61UR and upper recess 62UR. Likewise, the medial edge 60M can include rims 68R1 and 68R2 that bound the medial most portion along the medial edge 60M of the recess 61UR and 62UR. The respective rims can extend forwardly and or rearwardly from the respective projection 61UP. As shown in FIG. 3, the lower surface 60B of the plate can include similar rims 68 and 69 that bound the respective lower recesses 61LR and 62LR on the respective lateral 60L and medial 60M edges of the plate 60. As will be appreciated, similar rims can bound any of the other upper and lower recesses of the plate 60 found on the upper surface 60U and the lower surface 60B as shown.

The plate 60 of the current embodiment optionally can be configured with varying concavity and convexity. As shown in FIG. 5, the plate optionally can include a forefoot plate part 60R1 in the forefoot region 11, an arch plate part 60R2 in the arch region 12 and a heel plate part 60R3 in the heel region 13. The heel plate part 60R3 can be concave, or generally can bow downward, toward the ground G. This concave heel plate part 60R3 can extend forward from the first and third upper pillars 41, 43, through the opening 41O and optionally to the second 42 and fourth 44 upper pillars. In the arch region 12, the arch plate part 60R2 can be convex or generally can bow upward, away from the ground G. This arch plate part in its convex configuration can extend through the second opening 42O and to the fifth upper pillar 45 and sixth upper pillar 46 toward the third opening 43O that extends through the sole assembly 20. The forefoot plate part 60R1 can be concave, or generally can bow downward, toward the ground G. The concavity in this forefoot plate part, however, can be slightly greater than that of the heel plate part. In the forefoot plate part 60R1, the plate can be concave in such a manner that it follows multiple varying radii as shown in the current embodiment. However, in some cases, the plate optionally can include a constant radius in any portion of the plate that is concave.

The forefoot plate part can be concave forward and can extend through the third transverse opening 43O and through the fourth transverse opening 44O, to the anterior most point 60A of the plate 60. In some cases, depending on the application, the concavity or convexity of the plate can be reversed. In other cases, the concavity and or convexity can be increased or decreased depending on the suitable characteristics of the plate. Further optionally, certain ones of the plate parts can be flattened and made planar and/or can have different contours or characteristics than concave or convex curvatures.

Optionally, the plate 60 can have a similar or identical heel to toe drop as the upper surface 40U of the upper midsole 40. As an example, the plate 60 can vertically drop the same distance D1 from a location under the heel part 40UH to the forefoot part 40UT. This distance can be any of the distances mentioned above regarding that same heel to toe drop, for example, it may be in the range of about 10 mm to about 12 mm, or the other distances mentioned above.

The plate 60 can be sandwiched between the upper midsole 40 and the lower midsole 70. The plate can extend transversely across the longitudinal axis from a lateral edge 60L to a medial edge 60M. These lateral and medial edges of the plate can extend beyond one or more of the pillars to provide an aesthetic finish where the plate appears to project beyond the upper and lower midsoles. For example, as shown in FIG. 1, the first upper pillar 41 is disposed above and vertically aligned with the first lower pillar 71. The second upper pillar 42 likewise is aligned with and disposed above the second lower pillar 72. The lateral plate edge 60L can include a first lateral edge 61L that protrudes laterally, beyond the first upper pillar lower sidewall 41S and beyond the first lower pillar upper side wall 71S. The first lateral edge 61L is disposed between the first upper pillar and the first lower pillar, projecting a distance beyond the walls adjacent the plate so that the plate is visible and conspicuous to a viewer of the outside having footwear 10.

The first lateral edge 61L can transition or extend through the upper lateral void 40LV and the lower lateral void 70LV to the second lateral edge 62L. That second lateral edge 62L can project laterally beyond the lower sidewall 42S of the second pillar 42, as well as the upper sidewall 72S of the second pillar 72. That second lateral edge 62L can transition forward through multiple additional openings 42O, 43O, 44O. Between each of the respective openings, the lateral edge 60L can be disposed between upper and lower side walls of upper and lower pillars and can protrude laterally beyond each of the same, similar to that described in connection with the first lateral edge 61L and second lateral edge 62L.

With reference to FIGS. 1-3, the plate 60 can include one or more indentations along the lateral edge 60L and the medial edge 60M that can extend inward from those edges toward the longitudinal axis LA of the plate 60. These indentations can extend inward from the respective lateral edge 60L and medial edge 60M equal distances as shown. Of course, in other applications, the indentations can extend inward from the edges varying distances. Generally, each of the indentations can correspond with respective upper and lower voids and respective openings that extend through the sole assembly 20. The indentations can be substantially similar so only one set of indentations in the lateral and medial edges will be described here. In particular, the lateral edge 60L can include a first indentation 61I and the medial edge 60M can include a second indentation 62I. The first indentation 61I can be aligned with and can extend inward toward the longitudinal axis LA at a first location such that the upper lateral void 40LV is vertically aligned above the first indentation and 61I. This location also can be such that the lower lateral void 70LV is vertically aligned below the first indentation 61I. The indentation 61I can be disposed forwardly of the first upper pillar 41 and the first lower pillar 71. The first indentation 61I also can be located rearward of the second upper pillar 42 and the second lower pillar 72. Optionally, the indentation 61I can reduce the amount of material in the plate between the first and third pillars and the second and fourth pillars to reduce weight and/or to improve the flexibility of the plate that extends through the opening 41O. In turn, this can even out or make this portion of the plate more bendable relative to the other, wider portions of the plate forward of the void at the second lateral edge 62L and rearward of the void in the first lateral edge 61L.

Similarly, the medial edge 60M of the plate 60 optionally can define the second indentation 62I that extends inward from that medial edge 60M. This second indentation can be aligned with and can extend inward toward the longitudinal axis LA in a second location on the medial side of the longitudinal axis. The upper medial void 40MV can be vertically aligned above the second indentation 62I. The lower medial void 70MV can be vertically aligned below the second indentation. The first and second indentations can be aligned across the longitudinal axis LA from one another on the lateral and medial sides of the axis. In some cases, the indentations can be offset from one another on the lateral and medial sides, depending on the application. The first and second indentations on opposing lateral and medial edges also can be of varying depths, widths, lengths and thicknesses of the plate in those regions. In some cases, the indentations can be formed in the plate regions having the greater thickness T1 of the plate. The indentations also can be aligned with the ridges or projections 61UP and 61LP that extend across the plate from the lateral edge 60L to the medial edge 60M. Of course, in other applications the indentations can be formed in the thinner portions of the plate having a thickness T2 which can be less than the thickness T1.

Figure 8:
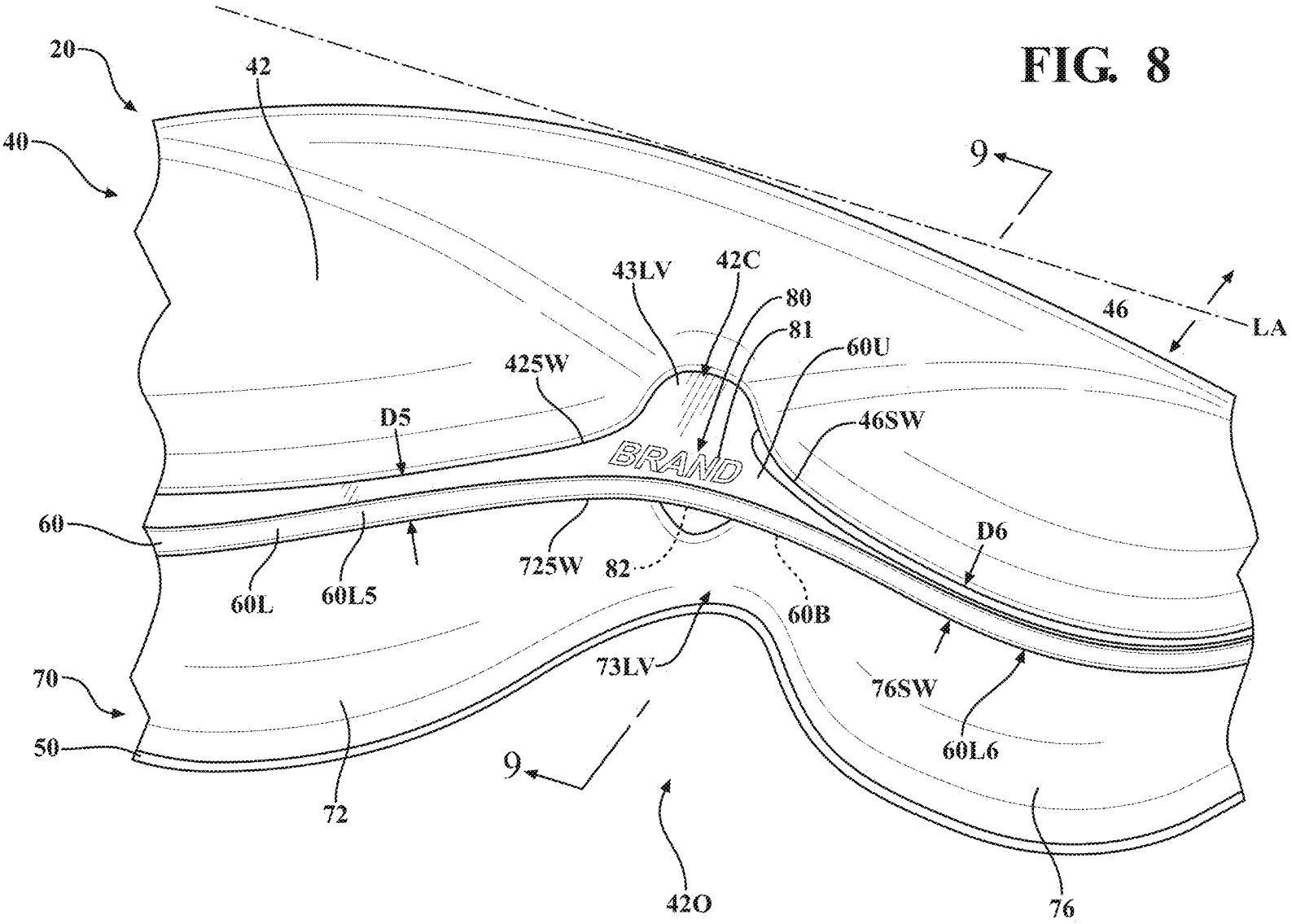
FIG. 8 is a perspective view of a branding bridge of the sole assembly.
Figure 9:
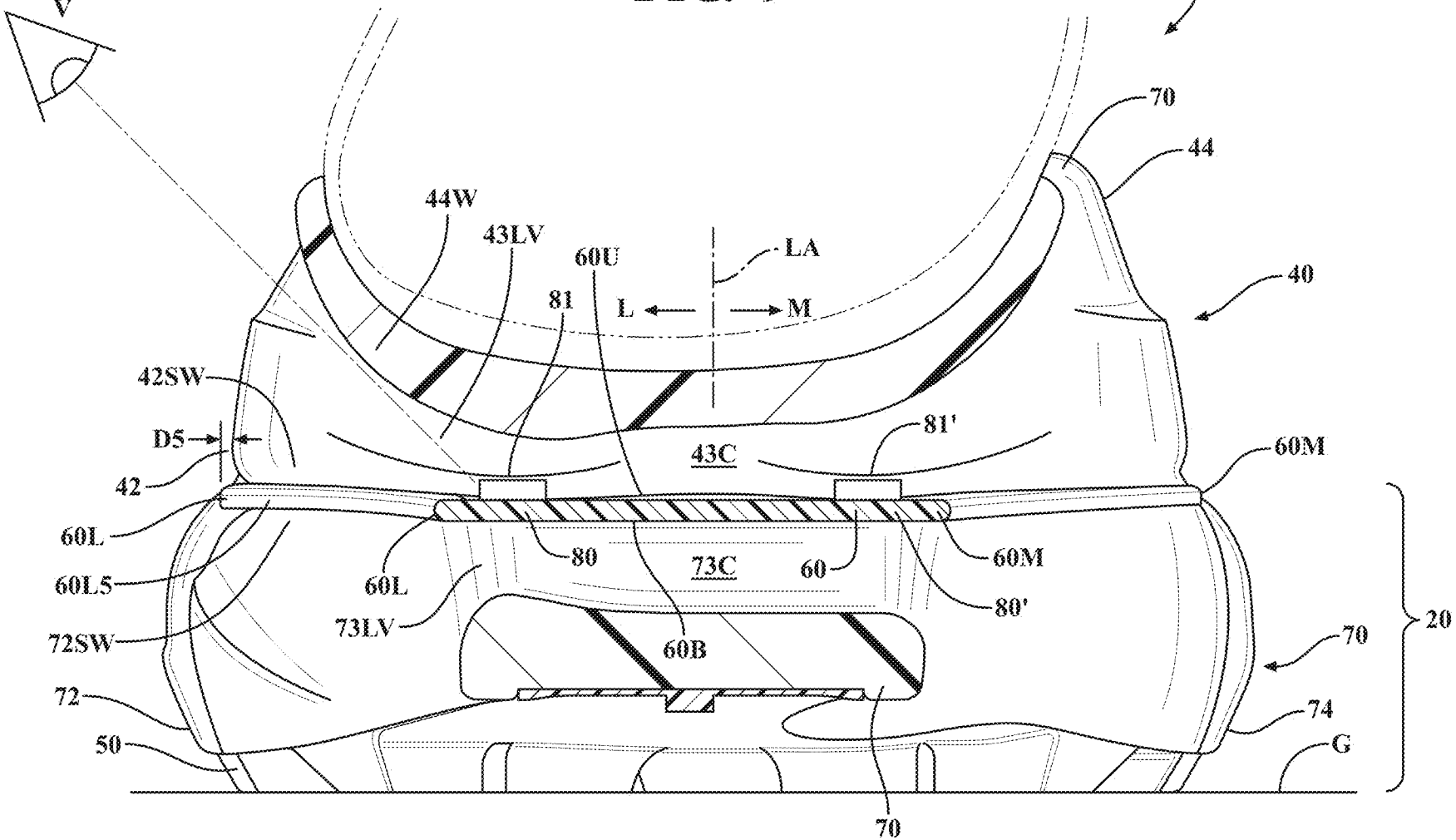
FIG. 9 is a section view of the sole assembly at the branding bridge taken along line 9-9 of FIG. 8.

Optionally, as shown in FIGS. 1, 8 and 9, the plate 60 can form a branding bridge 80. This branding bridge as illustrated can be disposed in the arch region 12, however in other applications and constructions, this branding bridge 80 can be disposed in the heel region 13 and/or the forefoot region 11. As illustrated in FIG. 8, the branding bridge 80 can include an indicia element 81 displayed on the plate's upper surface 60U. A second indicia element 82 optionally can be disposed on the lower surface 60B of the plate although not shown. The indicia element 81 can be in the form of raised or recessed indicia, such as alphanumeric characters, images, patterns, textures, logos, trade names, trademarks, symbols or other elements. In some cases, the indicia element 81 may be flat and planar and lay within the same plane as the upper surface 60U, or the lower surface 60B of the plate 60. The indicia element 81 can extend inward and can be disposed between upper and lower pillars forward and rearward of the opening 42O that extends within the sole assembly 20. The indicia element 81 can be displayed on the plate upper surface 60U and visible within the upper lateral void 43LV and/or a medial void if on the medial side of the longitudinal axis LA. The indicia element 81 can be located between optional lateral pillars 42 and 46 of the upper midsole 40, and generally between the lower midsole pillars 72 and 76 in the embodiment shown. Of course, when the bridge is included on the medial side of the sole assembly 20, it can be located between corresponding pillars there. In other applications, the branding bridge can be between any of the respective pillars along either the lateral or medial sides of the sole assembly 20.

With further reference to FIG. 8, the branding bridge 80 can transition to protruding lateral edges 60L5 and 60L6 forward and rearward of the opening 42O and generally forward and rearward of the upper lateral void 43LV. These protruding lateral edges 60L5 and 60L6 can protrude beyond the lower portions of the pillar side walls 42SW and 46SW respectively by distances D5 and D6. Distances D5 and D6 may or may not be equal. The branding bridge 80 also can transition inward into the upper lateral void 43LV and further into the internal compartment 42C as it transitions to the opposing medial void 43MV on the medial side of the sole assembly 20. Optionally, the indicia 81 faces upward as noted above. The lower surface of the plate 60B also optionally can be visible from a lower perspective view of the bottom of the sole assembly 20, in which view, the indicia element 81 is obscured from view. In some cases, the indicia element 81 can be absent from the lower plate surface 60B on the branding bridge 80 such that no branding or indicia is visible under the branding bridge on the lower plate surface, from a bottom view of the sole assembly or the footwear.

As shown in FIG. 9, the branding bridge 80 can project beyond a tangential or contoured surface 44W of the upper midsole 40 that bounds the upper portion of the upper lateral void 43LV. With this configuration, a viewer V can see and clearly view the indicia element 81 on the branding bridge 80 from a top or upper perspective view of the footwear, for example, when the footwear is on a ground surface G and the viewer is viewing that footwear. The location of the indicia element 81 at this location can display additional branding, advertising or information on the footwear. Optionally, an additional indicia element 81' can be disposed on the medial side of the footwear, along a secondary branding bridge 80' as shown in FIG. 9. In some cases, the indicia elements 81 and 81' can be a contiguous, single indicia element that extends across and transversely to the longitudinal axis, and that is visible to a viewer on both sides of the longitudinal axis from an upper or top perspective of the footwear 10.

As illustrated in FIGS. 8 and 9, the branding bridge 80 and the indicia element 81 are disposed in a covered area between the portions of the lateral edge 60L5 and 60L6. The branding bridge 80 and indicia element 81 can be vertically aligned between the pillars 42, 72 and 46, 76. The branding bridge and indicia element also can be vertically aligned within and with the upper lateral void 43LV and the lower lateral void 73LV. Of course, when the branding bridge is included on the medial side of the footwear, such bridge and indicia element can be aligned with corresponding upper medial void and lower medial void. Optionally, as mentioned above, the branding bridge and indicia element can be disposed between the other sets of pillars on the lateral and/or medial side of the footwear, in the heel region, arch region and/or the forefoot region of the footwear. To do so, the sizing of the pillars and voids, particularly the upper lateral and medial voids, can be altered to provide increased space for display of the indicia element along the lateral and/or medial edges of the plate. The construction and features of the branding bridge and the indicia element can be similar in those other configurations.

Optionally, there can be multiple branding bridges and indicia elements in one, two, three, four or more of the transverse openings that extend through the sole assembly 20. Moreover, in some cases, the branding bridge can be vertically aligned with indentations that are defined in the edge of the plate. The indicia element can hug or be disposed around the indentations and can extend into the upper voids and any internal compartment that extends across the longitudinal axis of the sole assembly 20.

Figure 10:
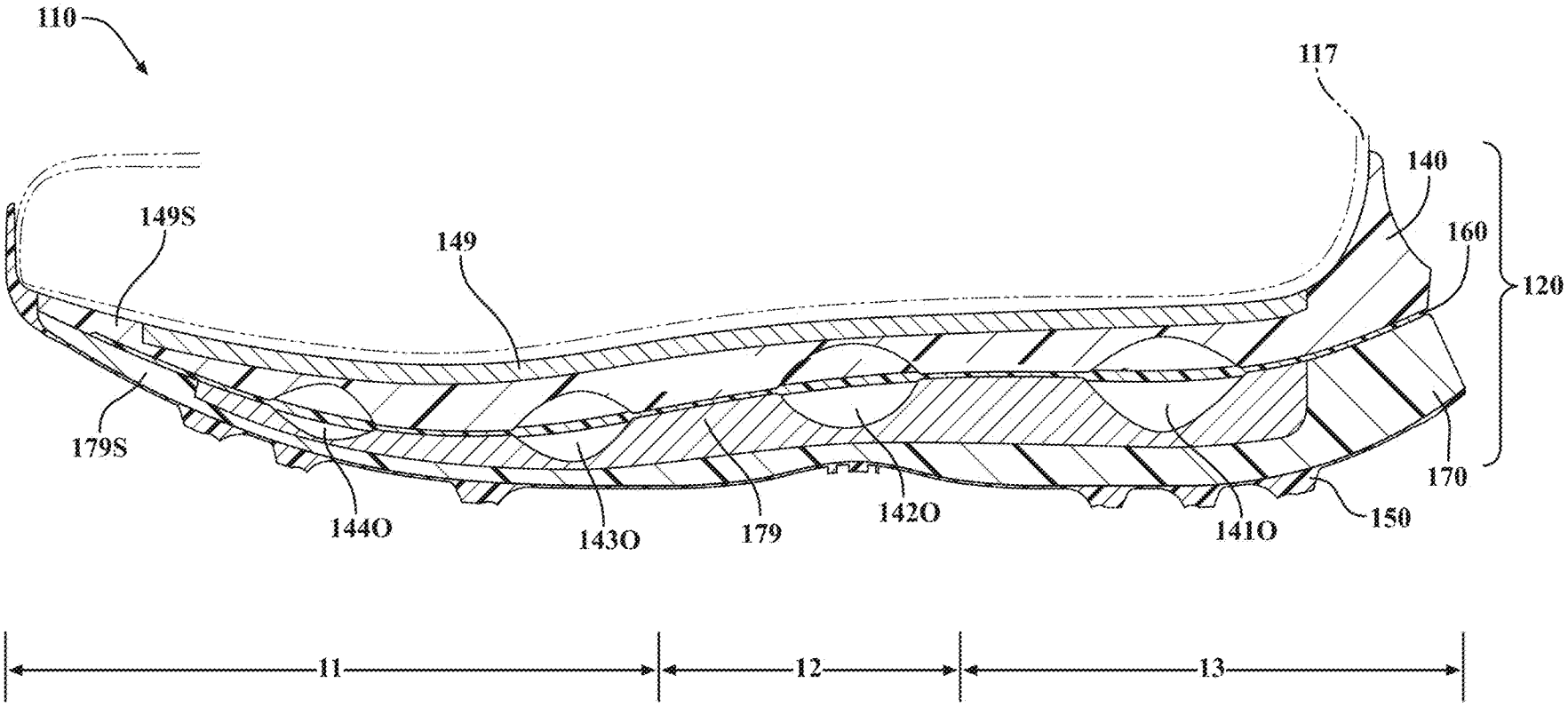
FIG. 10 is a section view of a sole assembly of a first alternative embodiment taken along lines 5-5 of FIG. 1 having different durometer, density or cell sizing regions in a sole assembly.

A first alternative embodiment of the footwear is shown in FIG. 10 and generally designated 110. This embodiment can be identical or similar in structure, function and operation to the embodiment described above with several exceptions. For example, the footwear 110 can include a sole assembly 120 including an upper midsole 140 joined with an upper 117, and a plate 160 sandwiched between that upper midsole 140 and a lower midsole 170, with an outsole 150 below the lower midsole. The upper midsole 140, however, can include an upper core 149. The lower midsole 170 likewise can include a lower core 179. The upper core 149 can be surrounded by an upper midsole shell or sidewall 149S and the lower midsole core 179 can be surrounded by a lower midsole shell or sidewall 179S. The cores and shells can be constructed from different materials having different properties, or the same materials having different properties.

Optionally, the respective cores and shells can be constructed from a variety of different combinations of materials and can have a variety of different durometer hardness. For example, the upper midsole core 149 can have a first durometer that is less than a second durometer of the shell 149S. The upper midsole core 149 can be constructed from a different material, or the same material having a different cell size or density than the shell 149S to provide the different durometer. Likewise, the lower midsole core 179 can have a third durometer that is less than a fourth durometer of the shell 179S. The lower midsole core 179 optionally can be constructed from a different material, or the same material having different cell size or density than the shell 179S to provide the different durometer. The durometers of the cores and shells can be mixed and matched to provide varying cushioning, stability and impact absorption, as well as traction in the sole assembly.

The cores 149 and/or 179 can have a durometer, or more particularly, an Asker C durometer hardness of optionally about 20 to about 30, inclusive, about 25 to about 30, inclusive, about 30 to about 50, inclusive, about 22 to about 25, inclusive, about 20 to about 25, inclusive, about 22 to about 27, inclusive, about 35 to about 45, inclusive, about 30 to about 45, inclusive, about 20 to about 35, inclusive, about 25, about 20, about 30, or other durometers, when determined using the above noted ASTM testing for durometer hardness. The shells 149S and 179S optionally can have different hardness or durometers of the upper midsole 40 and lower midsole 70 as described in the embodiments above.

Although shown as extending generally through the forefoot region 11, arch region 12 and heel region 13, each of the cores can be isolated to any one or two of those regions to provide localized cushioning or hardness to the sole assembly 120 there. Further, the upper midsole 140 and lower midsole 170 can be modified to include or not include the respective cores 149 and 179. For example, in some cases, the upper midsole 140 can include the core 149, but the lower midsole 170 might not include the core 179. Conversely, the upper midsole 140 might not include the core 149, but the lower midsole 170 might include the core 179. Further, the cores can be modified in shape and the extent that they overlap the openings 141O, 142O, 143O and 144O to provide satisfactory cushioning in those regions. When the sole assembly achieves the compressed or collapsed state as described in the embodiment above, the cores 149 and 179 also can be selected based on density, hardness or other properties to satisfactorily deform the respective pillars thereof, and to interface and/or interact with the plate 160 in different regions along the length of the sole assembly 120.

Figure 11:
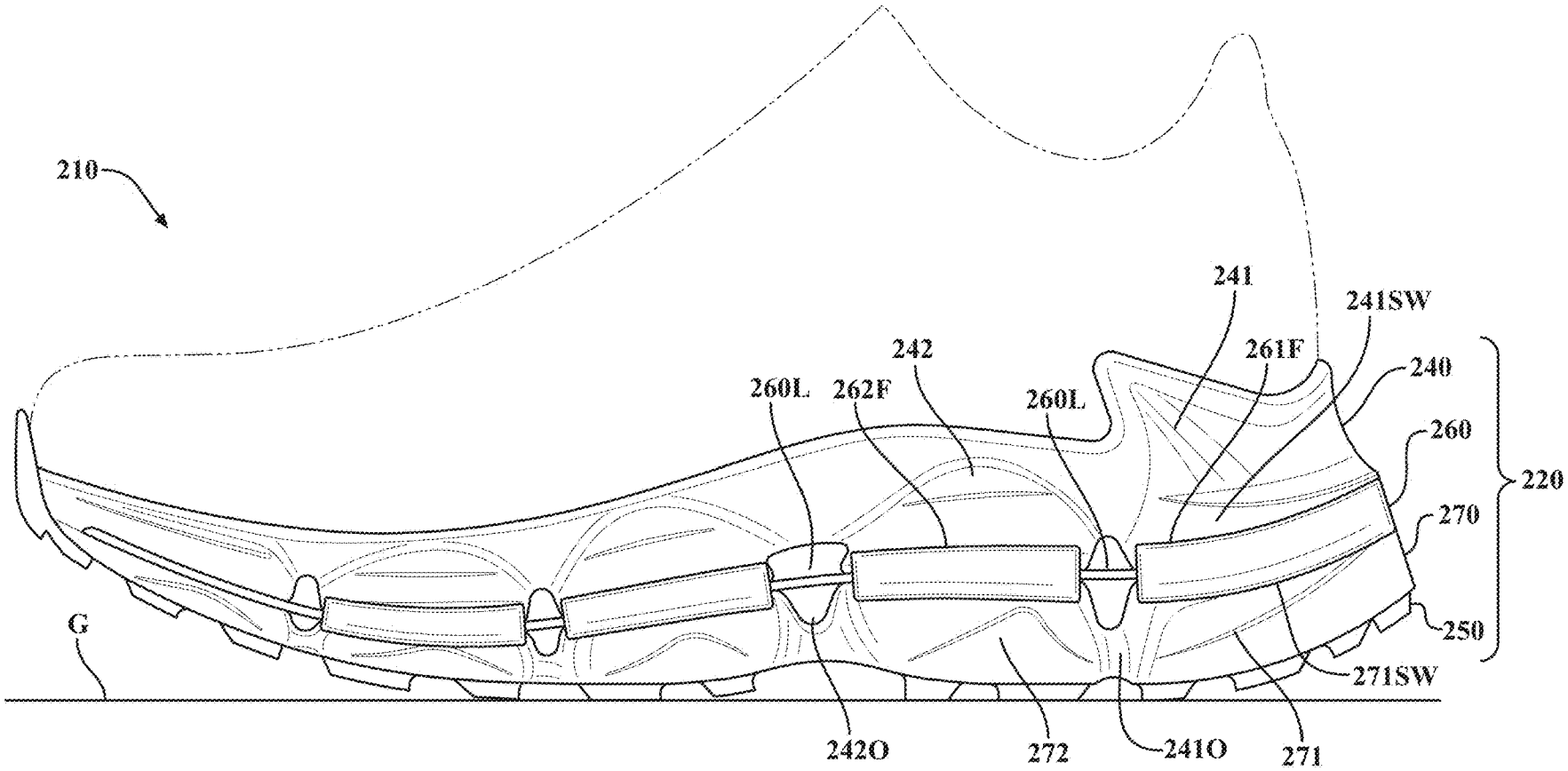
FIG. 11 is a side view of a sole assembly of a second alternative embodiment having a sole assembly with a plate including reinforcing or stability elements.
Figure 12:
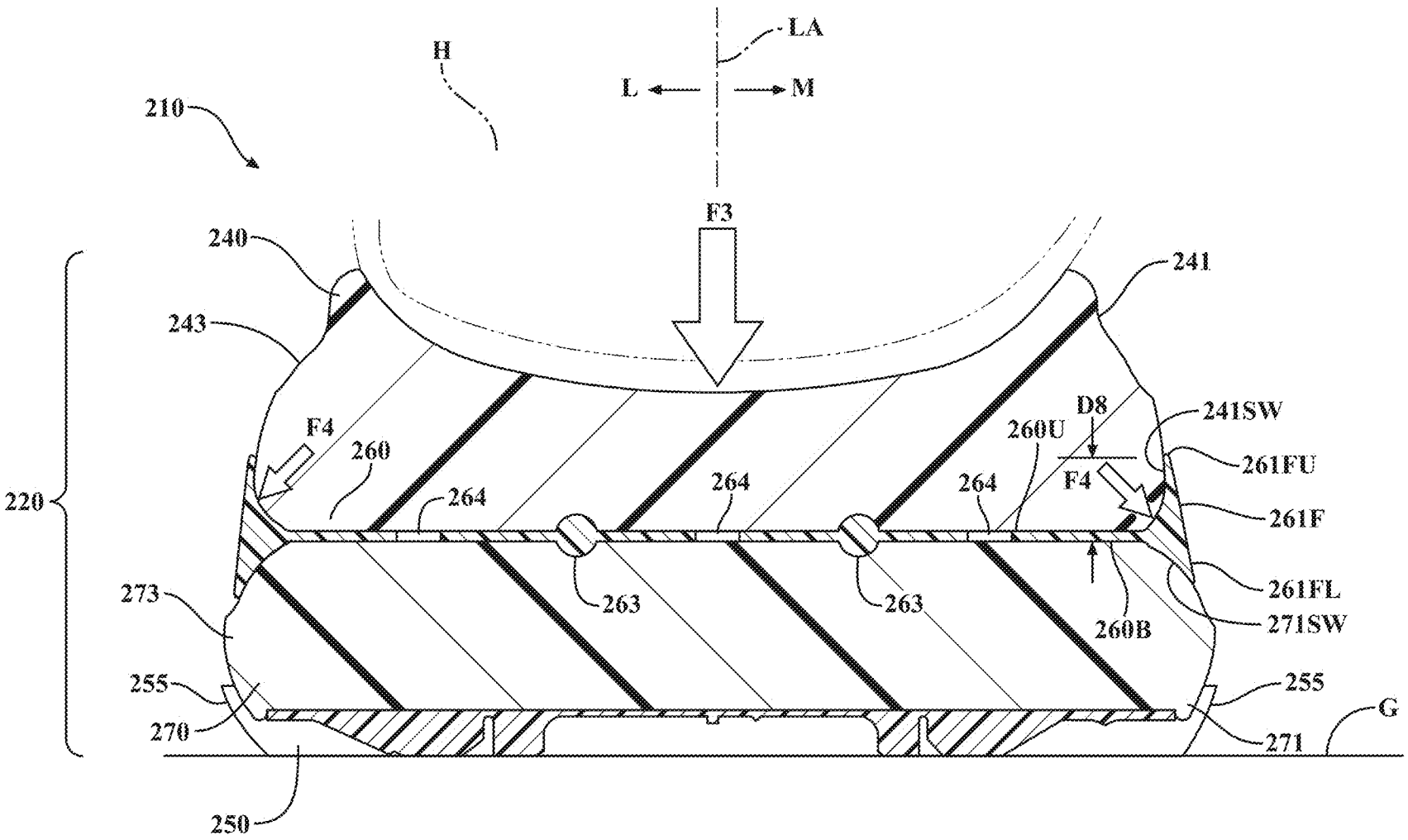
FIG. 12 is a section view of a sole assembly of the second alternative embodiment, taken transverse to a length of the sole assembly, having the plate including reinforcing or stability elements.

A second alternative embodiment of the footwear is shown in FIGS. 11 and 12 and generally designated 210. The footwear 210 shown there can be identical or similar in structure, function and operation to the embodiments described above with several exceptions. For example, the footwear 210 can include a sole assembly 220 including an upper midsole 240 and a lower midsole 270 with a plate 260 sandwiched therebetween. The sole assembly 220 can further include an outsole 250 that is secured to the lower portion of the lower midsole 270.

The plate 260, however in this construction, can vary from that of the embodiments above in several ways. For example, as shown in FIG. 11, the plate 260 can be constructed to include features that can interface with the respective upper midsole pillars and lower midsole pillars, to provide enhanced stability, improve rigidity, focus flexibility and/or to control the compression of those pillars. In particular, the plate 260 can include edges that can be selectively flared to form structural boundaries around respective upper and lower pillars. As shown in FIGS. 11 and 12, the upper midsole 240 can include a first upper pillar 241 and a first lower pillar 271, as well as a second upper pillar 272 and a second lower pillar 272. These pillars can be disposed above and below the plate 260 as with the embodiments above. However, at the locations where the plate overlaps with the pillars, optionally between the respective openings 241O and 242O, the plate can include flares or enlarged edges. For example, the lateral edge 260L of the plate can extend around the lower sidewall 241SW of the first pillar 241. The lateral edge can include and/or transition to a flare 261F there, which can extend upwardly along the lower sidewall 241SW of the pillar 241. The flare 261F can include an upper portion 261FU that projects upwardly, above the upper surface 260U of the plate 260. This flare upper portion 261FU can extend a distance D8 above that upper surface 260U of the plate 260. This distance D8 can be greater than at least two, three, four or five times the thickness of the plate 260. The flare can form a perimeter around the lower sidewall 241SW of the first upper pillar 241. The flare might stop at the forward part of the pillar, without extending across the opening 241O.

The flare 261F optionally can include a lower flare portion 261FL that extends downward, below the lower surface 260B of the plate come along the upper side wall 271SW of the first lower pillar 271. This lower flare portion 261FL of the flare can extend a similar distance to that of D8. Of course, the respective flair portions 261FU and 261FL can be of varying sizes and proportions, depending on the function of them and interaction of those flare portions with the respective upper and lower pillars.

The flares can include a radius or rounded interior portion to cleanly and fully or partially engage the lower sidewall 241SW and upper sidewall 271SW of the respective pillars. In other cases, the flare 261F can be a planar plate or wall that extends vertically or perpendicular to the upper and lower surfaces of the plate. In yet other cases, the flares can include outer contours and optionally can further include indicia elements like those described above in connection with the branding bridge of the embodiments above. In this manner, additional branding, advertising and/or images can be displayed along the flares exterior surfaces that can remain exposed between the upper and lower midsoles.

The flares can be configured to control the expansion of the upper and lower pillars of the upper midsole 240 and lower midsole 270. For example, as shown in FIG. 12, when a heel H of a wearer of the footwear 10 transfers an impact force F3 to the sole assembly 220, that force F3 can be dissipated through the upper pillars and lower pillars. In the upper pillars, the force F3 sometimes can produce lateral forces and/or shear forces F4 that can cause the pillars to bulge outward, toward the lateral and medial edges of the plate and beyond. With the flares of this embodiment, however, those structures engage the lower side walls of the upper pillars and impair or prevent the upper pillars from bulging excessively or otherwise producing a side to side rolling sensation in the sole assembly 220. Likewise, where the flares extend downward over the upper sidewalls 271SW of the lower pillars, any lateral forces that may otherwise cause bulging of the lower pillars in those regions of the side walls can be countered and controlled. Again, this can prevent or impair excessive bulging of the lower pillars.

Optionally, in some cases, the outsole 250 can include upwardly extending flanges 255 that extend upward along the lower portions of the lower pillars, or generally upward along the lower portions of the lower midsole. These flanges 255 can follow the rounded contours of the pillars in those regions. Accordingly, the flanges 255 can function to reduce the bulging of the lower pillars of the lower midsole 270. In turn, this can provide a feeling of enhanced stability and can impair or prevent rolling of the sole assembly due to shear forces acting on the lower midsole.

Further optionally, as shown in FIG. 12, the plate 260 can include one or more ribs 263. The ribs can be in the form of simple projections that extend upwardly from the upper surface 260U and/or the lower surface 260B of the plate. The ribs 263 can extend longitudinally, along and/or aligned with the longitudinal axis as shown. In alternative embodiments, the ribs can extend transversely to the longitudinal axis, crossing from a medial side to a lateral side or vice versa, while being wholly contained on the lateral or medial sides of the longitudinal axis. The ribs 263 can extend through one or more of the heel region, the arch region and/or the forefoot region of the sole assembly 120. The ribs can provide enhanced rigidity in localized areas of the plate.

Yet further optionally, the plate 260 can define one or more slots 264. These slots can extend through the plate from the upper surface 260U to the lower surface 260B and can generally be located between the lateral and medial edges of the plate. The slots can extend parallel to or aligned with longitudinal axis, and can be located on the lateral L and/or medial M sides of the longitudinal axis LA. The slots can be disposed in one or more of the heel region, the arch region and/or the forefoot region. The slots can provide localized flexibility to the plate in certain applications.

Figure 13:
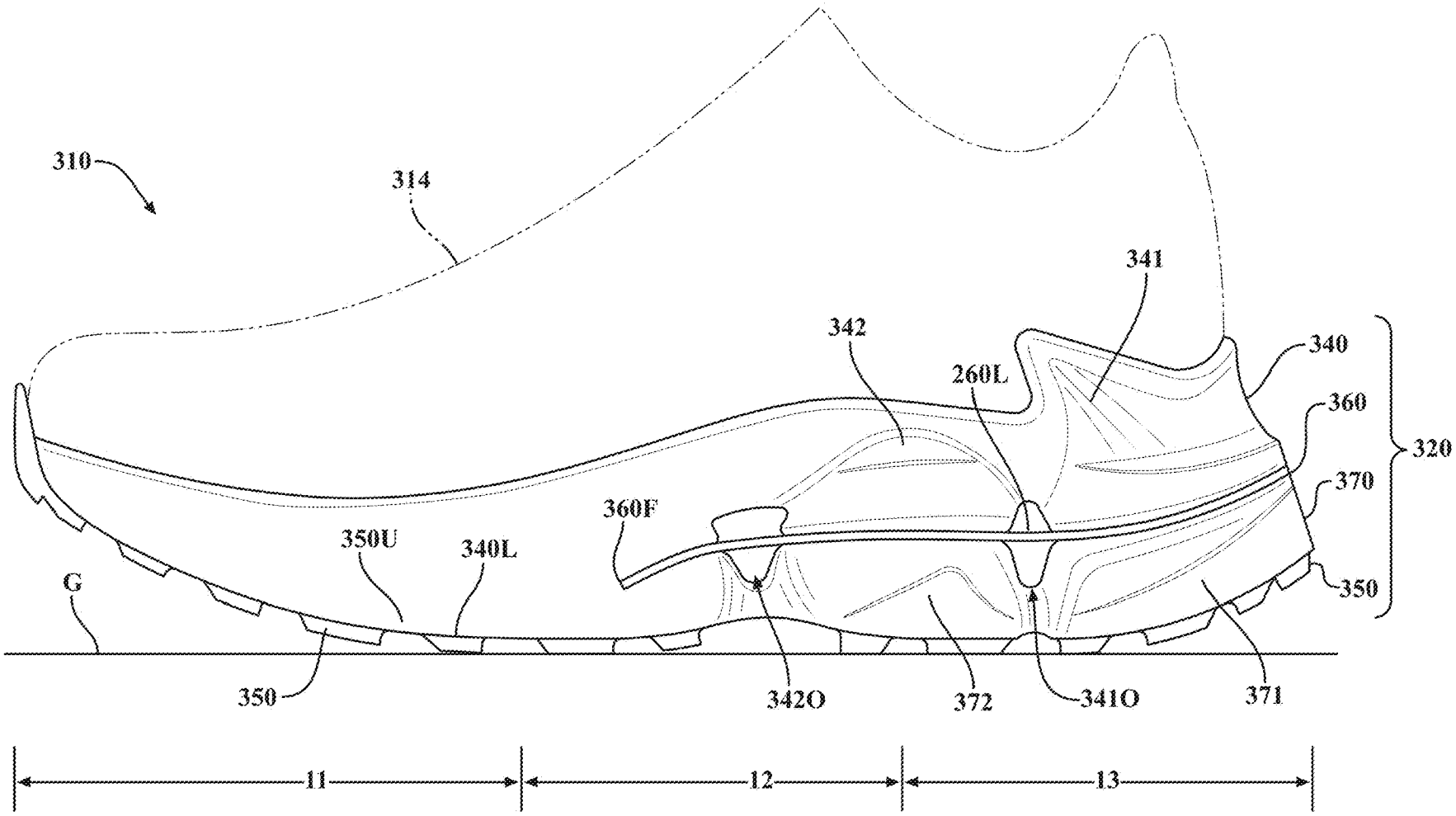
FIG. 13 is a side view of a sole assembly of a third alternative embodiment having an upper midsole, a lower midsole and/or plate that terminate slightly forward of a heel region with a full height midsole disposed in the forefoot region.

A third alternative embodiment of the footwear is shown in FIG. 13 and generally designated 310. This embodiment can be identical or similar to the embodiments described above in structure, function and operation with several exceptions. For example, this embodiment can include a sole assembly 320 including an upper midsole 340, a lower midsole 370, a plate 360 sandwiched between the upper midsole 340 and lower midsole 370, and an outsole 350. This embodiment also can include upper pillars, for example 341 and 342, as well as lower pillars 371 and 372, disposed respectively above and below the plate 360. The pillars can be separated by an opening 341O having similar voids and internal compartments as the embodiments above. In the heel region 13 forwardly to the second opening 342O, virtually all of the components of the sole assembly 320 can be similar or identical to that of the first embodiment of the sole assembly 20 described above.

In this embodiment, however, forward of the heel region 13, the lower midsole 370 and plate can terminate in the arch region 12 and/or the forefoot region 11. The upper midsole 340 can transition downward in these regions so that its lower surface 340L engages and contacts the upper surface 350U of the outsole 350. In this construction, the lower midsole 370 also can end or terminate generally in the heel region 13 and/or in the arch region 12. Optionally, the lower midsole 370 does not extend substantially into the forefoot region. Of course, depending on the application, the lower midsole 370 can extend farther into the forefoot region or stop or terminate closer to the heel region, depending on the application. The plate 360 in this embodiment can include a forward-most point 360F that terminates rearward of the forefoot region 11, optionally in the arch region and/or the heel region 13.

Optionally, the sole assembly 320 of this embodiment can be a hybrid construction including the pillars and plate of the embodiments described above in the heel region 13 and/or the arch region 12, and a different construction in the forefoot 11 and/or arch region 12, where a single midsole 340 is disposed below the upper 314, between that upper and the outsole 350. In this hybrid construction, the pillars, plates and openings can provide enhanced cushioning and impact absorption as well as energy return in the heel region 13, and the upper midsole 340 can function more like a single layer midsole in the forefoot region 11 to provide stable propulsion and toe off there to a wearer of the footwear 310.

Although this hybrid construction includes the upper and lower pillars, plate, openings, voids and compartments in the heel region 13, with the single layer midsole 340 in the forefoot 11, those constructions can be reversed, with the pillars, plate, openings, voids and compartments in the forefoot region 11 and/or the arch region 12, and the single layer midsole or some other construction in the heel region 13. Further optionally, the pillars, plate, openings, voids and compartments can be disposed in the arch region 12, with a single layer midsole disposed in the forefoot region 11 and the heel region 13. A variety of other combinations of these constructions can be included in the sole assembly 320, depending on the application.

Additional alternative embodiments of the footwear are shown in FIGS. 14-22. These embodiments can be identical or similar to the embodiments described above in structure, function and operation with several exceptions. For example, these embodiments can include a sole assembly including an upper midsole, a lower midsole, a plate sandwiched between the upper midsole and lower midsole, and an outsole. These embodiments also can include upper pillars, lower pillars, pillar pods and/or solid unitary midsole parts mixed and matched in the forefoot region, the heel region and/or forefoot region in various combinations and disposed above and/or below the plate. The pillars and walls of the midsole portions can be separated by one or more openings having similar voids and internal compartments as the embodiments above. Moreover, the respective function, operation and components of the openings, plate, pillar pods and pillars in the embodiments below can be similar or identical to those in the embodiments above to provide cushioning, energy return and/or impact absorption. Further, the plates of all the below embodiments can include the same or similar concavity and convexity of plate contours as described in the embodiments above. In addition, the sole assemblies of all the below embodiments can include an upper midsole or sole assembly configured to provide a particular heel to toe drop or distance that accommodates various hiking or trail running styles similar or identical to those of the embodiment in FIG. 5, with the heel to toe drop optionally at least 8 mm, at least 10 mm, at least 12 mm, at least 14 mm, 8 mm to 14 mm, inclusive, 8 mm to 12 mm, inclusive, or 10 mm to 12 mm, inclusive, or other distances depending on the application.

Figure 14:
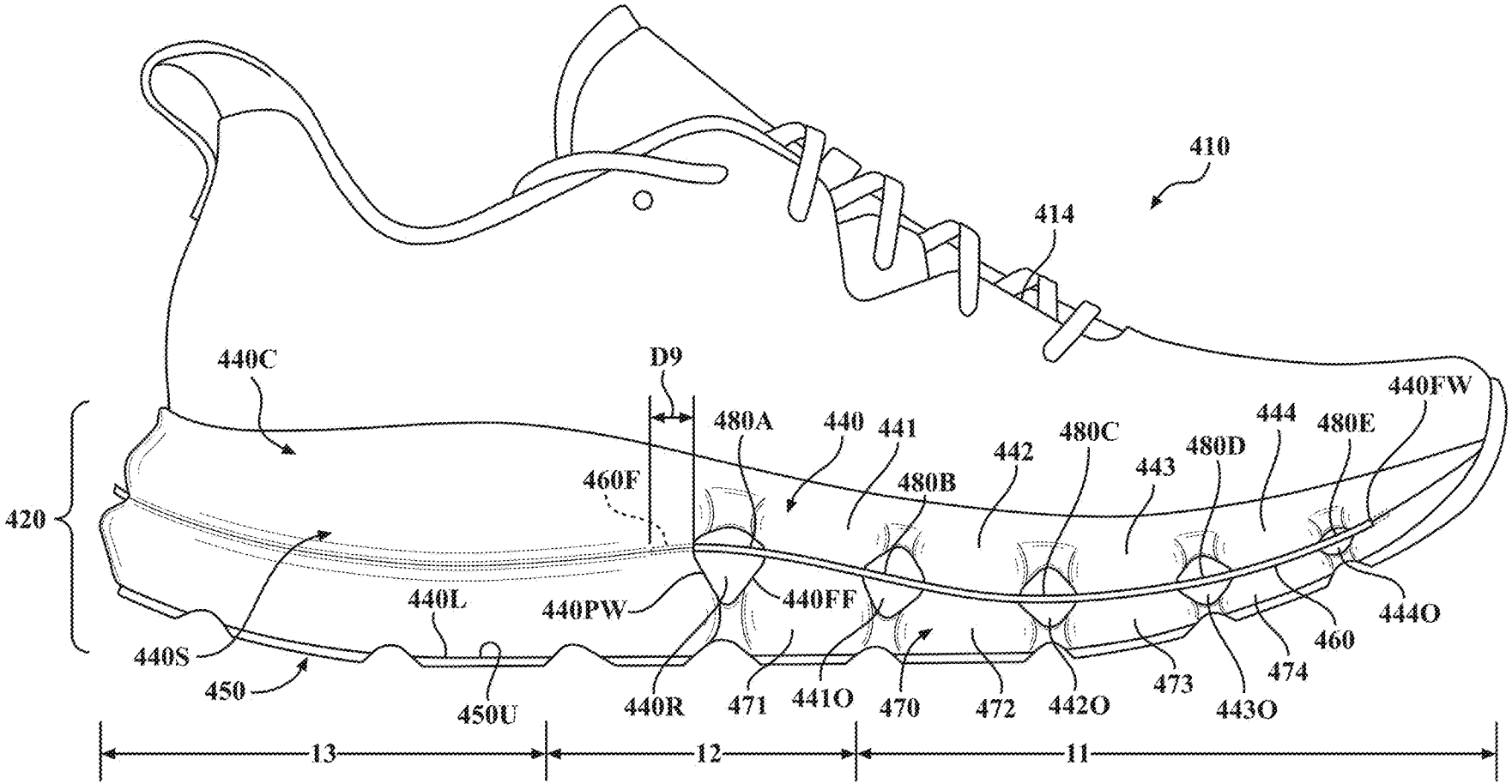
FIG. 14 is a side view of a sole assembly of a fourth alternative embodiment having an upper midsole, a lower midsole and/or plate that terminate slightly rearward of or in an arch region with a full height midsole disposed in the heel region and/or part of the arch.

More particularly, a fourth alternative embodiment of the footwear is shown in FIG. 14 and generally designated 410. This embodiment can be identical or similar to the embodiments described above in structure, function and operation with several exceptions. For example, this embodiment can be the reverse of the third alternative embodiment shown in FIG. 13. This embodiment can include a sole assembly 420 including an upper midsole 440, a lower midsole 470, a plate 460 sandwiched between the upper midsole 440 and lower midsole 470, and an outsole 450. This embodiment also can include upper pillars, for example 441-444 as well as lower pillars 471-474, disposed respectively above and below the plate 460 as in the embodiments above. The pillars can be separated by respective openings 441O-444O having similar voids and internal compartments as the embodiments above.

In the forefoot region 11 rearwardly to the arch opening 440R, virtually all the components of the sole assembly 420 can be similar or identical in structure, function and operation to that of the first embodiment of the sole assembly 20 described above, and therefore will not be described again here in detail.

In this embodiment, rearward of the forefoot region 11, the lower midsole 470 and plate 460 can terminate in the arch region 12 and/or in the heel region 13. The upper midsole 440 can transition downward in these regions so that its lower surface 440L engages and contacts the upper surface 450U of the outsole 450. In this construction, the lower midsole 470 also can end or terminate generally in the forefoot region 11 and/or in the arch region 12. Optionally, the lower midsole 470 does not extend substantially into the heel region. Of course, depending on the application, the lower midsole 470 can extend farther into the heel region. The plate 460 in this embodiment can include a rearwardmost point 460F that terminates forward of the heel region 13, optionally in the arch region and/or the heel region 13.

Optionally, the sole assembly 420 of this embodiment can be a hybrid construction including the pillars and plate of the embodiments described above in the forefoot region 11 and/or the arch region 12, and a different construction in the heel regions 13 and/or arch region 12, where a single, unitary midsole 440S is disposed below the upper 414, between that upper and the outsole 450. In this hybrid construction, the pillars, plates and openings can provide enhanced cushioning and impact absorption as well as energy return in the forefoot region 11, and the single midsole 440S, which does not include a plate extending completely along its length, nor pillars or voids or openings, for example, extending through the midsole from a lateral side to a medial side, as described in the embodiments above, can function more like a single layer midsole in the heel region 13 to provide a stable and impact absorbing heel cup and/or heel padding and impact absorption there.

In this and the other embodiments, the plate 460 also can include one or more branding bridges 480A-480E between the respective upper pillars, with one or more respective indicia elements on those bridges, and exposed in the openings to provide advertising, images or other aesthetic features on the plate, inset from the sidewalls of the pillars and within the respective openings. The branding bridges and respective indicia elements can be similar or identical to the branding bridge 80 and indicia element 81 of the embodiments above. As one nonlimiting example, the indicia elements on the bridges 480A-480B can be in the form of raised or recessed indicia, such as alphanumeric characters, images, patterns, textures, logos, trade names, trademarks, symbols or other elements. In some cases, the indicia elements can be flat and planar and lay within the same plane as the upper surface or the lower surface of the plate 460. The indicia elements can extend inward and can be disposed between upper and/or lower pillars forward and rearward of the openings in the forefoot.

In this embodiment, shown in FIG. 14, the rearmost opening 440R can be defined at least partially by a rear pillar wall 440PW, which can be part of the single uniform or integral midsole 440S, as well as a forward pillar wall 440FF, which can be part of a pillar 441. This midsole 440S can be integrally formed with the upper midsole 440 and upper pillars 441, etc., over the plate. This midsole 440S optionally can be a different material and formed from a different, separate and independent element than the lower pillars 470. Of course, in some application, these components can be formed from the same material, and integral with one another. In some applications, the plate 460 can extend and/or penetrate through the rear pillar wall, 440PW, a distance D9 into the midsole 440S. This distance can be optionally 1 mm to 10 mm, inclusive, 2 mm to 15 mm inclusive, 5 mm to 25 mm inclusive, or other distances. The plate in this area can be adhered to, bonded to, embedded in, fused to, and/or encapsulated in the material from which the single midsole 440S is constructed. The material can be physically or chemically bonded or fused to the plate upper and lower surfaces here. The plate 460 also can extend into the front pillar wall 440FW in a comparable manner. In some cases, the plate can be overmolded by the material to bond or fuse that material to the plate.

Optionally, beyond the rear pillar wall 440PW and into the unitary single midsole 440S, that midsole 440S can be solid and without openings or voids as defined in the upper midsole and lower midsole features in the forefoot. The unitary midsole can extend uniformly through the height, width and length of the volume of the midsole beyond the rear pillar wall. The unitary midsole can extend rearwardly through the heel regions and can form an integral or separate heel cup 440C, which can extend upward along parts of the upper 414. The unitary midsole also can be void of any clearly defined pillars and the plate in the heel region 13 and/or the arch region.

Figure 15:
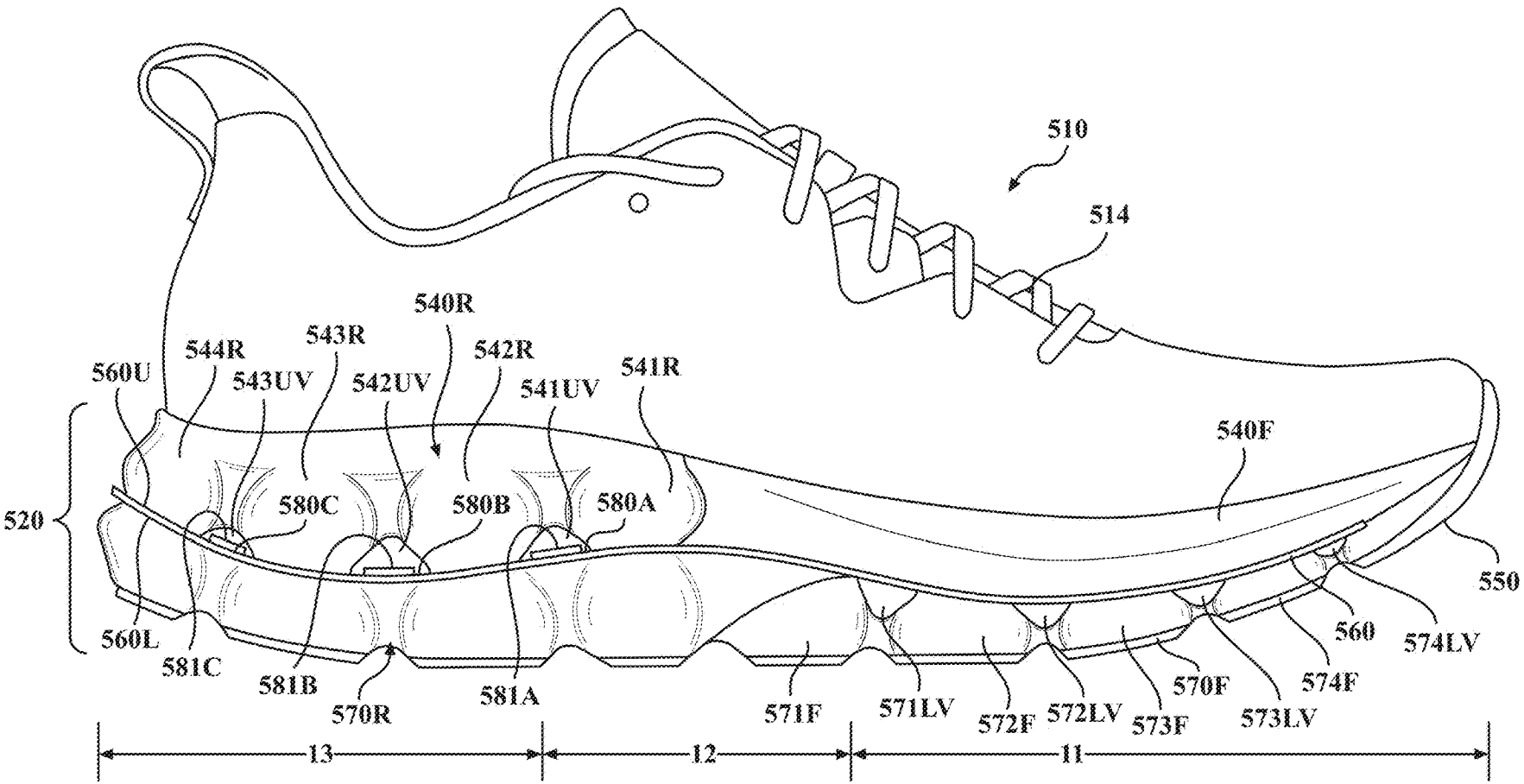
FIG. 15 is a side view of a sole assembly of a fifth alternative embodiment having a pillared upper midsole in the heel region, a solid or continuous upper midsole in the forefoot region, a plate under these upper midsoles, a pillared lower midsole in the forefoot region, and a solid or continuous lower midsole in the heel region.

A fifth alternative embodiment of the footwear is shown in FIG. 15 and generally designated 510. This embodiment can be identical or similar to the embodiments described above in structure, function and operation with several exceptions. For example, this embodiment can include a sole assembly 520 including a rearward upper midsole 540R, a rearward lower midsole 570R, a forward upper midsole 540F, a forward lower midsole 570F, a plate 560 sandwiched between the upper midsoles 540R, 540F and lower midsoles 570R, 570F, and an outsole 550.

In this embodiment, the rearward upper midsole 540R can include multiple upper pillars 541R-544R. These pillars can extend downward to the plate 560 and can form upper voids or upper openings 541UV-543UV above the plate 560. The pillars of this embodiment can be similar or identical to the other pillars described in other embodiments herein and can include the various elements and components thereof. The upper voids can be similar or identical to the upper opening or upper void 41O described in the current embodiment above and including all the pillar walls and surfaces of that void or others described in the current embodiment, which will not be described again here. The plate can define one or more indentations in this region, between the upper pillars, the indentations and characteristics of the plate being similar to that of the plate 60 in the embodiment described above.

Optionally, the plate 560 in this region can include one or more branding bridges 580A-580C, which can include one or more indicia elements 581A-581C. These branding bridges can be similar or identical to the branding bridge 80 described in connection with the current embodiment above, and the indicia elements can be similar or identical to the indicia elements described above. The plate also can include one or more pillar recesses and thickened regions as explained in connection with the current embodiment first described above, with the pillars fitting into these recesses, and positioned with respective shoulders of those recesses as with the embodiments above.

Optionally, the rear lower midsole 570R can be joined with the lower surface 560L of the plate in the heel region. This rear lower midsole 570R can be without any openings or lower voids like those of the current embodiment first described above. Instead, this lower midsole 570R can be substantially solid and contiguous from the lateral side to the medial side of the sole, and from its lower surface to the plate. There can, however, be outer lateral and medial contours that can follow the outer perimeter or edges of the plate 560. The lower surfaces of the branding bridges can also be covered by this rear lower midsole 570R in the heel region 13 and part of the arch region 12.

The rear lower midsole 570R can transition through the arch region to the forward lower midsole 570F, both being located under the plate 560. These rear and front lower midsoles optionally can be constructed from different materials, can have different durometers, or different structures as shown. For example, as mentioned above the rear lower midsole can be contiguous and generally solid thorough the heel region 13. The front or forward lower midsole 570F can include multiple lower pillars 571F-574F. These lower pillars can extend upward to the plate 560 and can form upper voids or upper openings 571LV-544LV below the plate 560. These lower voids can be similar or identical to the upper opening or upper void 71O described in the current embodiment above, and including all the pillar walls and surfaces of that void or others described in the current embodiment, which will not be described again here. The plate can define one or more indentations in this region, between the lower pillars, the indentations and characteristics of the plate being similar to that of the plate 60 in the embodiment described above. The plate also can include one or more pillar recesses and thickened regions as explained in connection with the current embodiment first described above, with the lower pillars fitting in these recesses, and positioned with respective shoulders of those recesses as with the embodiments above.

As explained above, the rear upper midsole 540R can be joined with the upper surface 560U of the plate in the heel region 13. This rear upper midsole 540R can extend into the arch but can terminate short of the forward upper midsole 540F. The rear upper midsole 540R can transition to the front upper midsole 540F. Like the rear lower midsole 570R, this front upper midsole can be without any openings or lower voids like those of the current embodiment first described above. The front upper midsole 540F can be substantially solid and continuous from the lateral side to the medial side of the sole, and from its upper surface to the plate. There can, however, be outer lateral and medial contours that can follow the outer perimeter or edges of the plate 560. The upper surface of the plate in the forefoot 11 can be covered by this front upper midsole 540F in and part of the arch region 12, in which case, the branding bridges can be isolated to the heel region 13 of the sole assembly.

The rear upper midsole can transition through the arch region to the forward upper midsole, with both being located above the plate 560. These rear and front upper midsoles optionally can be constructed from different materials, can have different durometers, or different structures as shown. Both of the upper midsoles 540R and 540F can be disposed above the upper surface of the plate, while both of the lower midsoles 570R and 570F can be disposed under the lower surface of the plate. Each of the respective midsoles can be adhered, welded, bonded or otherwise secured to the respective upper and lower surfaces of the plate using any of the techniques or materials described in the embodiments above. Further optionally, as shown in FIG. 15, the sole assembly can include a hybrid midsole construction, with a pillared, void including midsole construction in the rear upper midsole and the front lower midsole, and a solid, continuous midsole construction in the rear lower midsole and front upper midsole.

Figure 16:
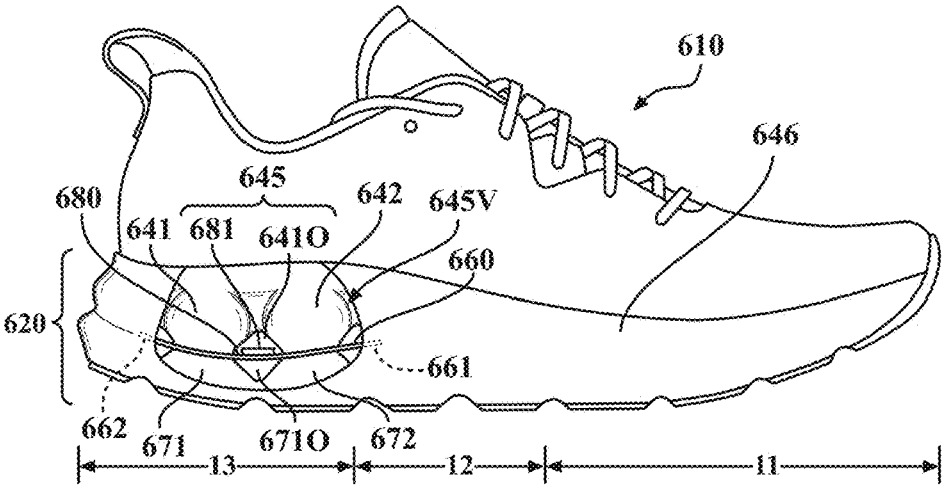
FIG. 16 is a side view of a sole assembly of a sixth alternative embodiment having an isolated pillar pod and plate in the heel region, with a solid or continuous midsole in the arch region and/or forefoot region.

A sixth alternative embodiment of the footwear is shown in FIG. 16 and generally designated 610. This embodiment can be identical or similar to the embodiments described above in structure, function and operation with several exceptions. For example, this embodiment can include a sole assembly 620 including an isolated pillar pod 645 and plate 660 in the heel region 13, with a solid or continuous midsole 646 in the arch region 12 and/or forefoot region 11. A plate 660 can be sandwiched between the upper and lower midsoles 640, 670 in the isolated pillar pod 645, above the outsole 650. In this embodiment, the isolated pillar pod can include upper pillars 641, 642, which like the other embodiments herein can actually be pairs of lateral and medial pillars. These upper pillars can be identical or similar to the upper pillars 41, 42 described in the current embodiment above, and can include the various elements and components thereof. The lower pillars 671, 672, which like the other embodiments herein can actually be pairs of lateral and medial pillars. These lower pillars can be identical or similar to the lower pillars 71, 72 described in the current embodiment above, and can include the various elements and components thereof. The upper pillars and plate can define at least one upper void that can be similar or identical to the upper opening or upper void 41O described in the current embodiment above and including all the pillar walls and surfaces of that void or others described in the current embodiment, which will not be described again here. The lower pillars and plate can define at least one lower void that can be similar or identical to the upper opening or lower void 71O described in the current embodiment above and including all the pillar walls and surfaces of that void or others described in the current embodiment, which will not be described again here.

The plate 660 can define one or more indentations in this region, between the upper pillars, the indentations and characteristics of the plate being similar to that of the plate 60 in the embodiment described above. Further, the plate 660 in this region can include one or more branding bridges 680A, which can include one or more indicia elements 681A. The branding bridge can be similar or identical to the branding bridge 80 described in connection with the current embodiment above, and the indicia element can be similar or identical to the indicia element 81 described above. The plate also can include one or more pillar recesses and thickened regions as explained in connection with the current embodiment first described above, with the pillars fitting into these recesses, and positioned with respective shoulders of those recesses as with the embodiments above.

As shown in FIG. 16, the upper and lower pillars and the plate can be spatially confined to a pillar pod 645, which can be defined in the heel region 13 of the sole assembly. The pillar pod 645 can be disposed in a recess or void 645V that is defined in a midsole 646. The midsole can be a solid, continuous midsole that extends from the forefoot to the heel, optionally constructed from foam, gel, padding or some other cushioning material. The void can be defined in the heel region of the solid midsole. Forward of the pod 645, the midsole can extend through the arch region 12 and the forefoot region 11. This portion of the midsole 646 can be void of any openings, voids, pillars and/or the plate. The plate 660 can extend through the pod and void 645V. In some cases, forward and rearward ends 661 and 662 of the plate 660 can extend into the walls of the midsole 646 bounding the void. The plate can be embedded, fused, adhered and/or bonded to the midsole in these regions to provide securement of the plate therein. Optionally, although shown as extending only to the end 661, terminating in the heel or arch region, the plate 660 can extend within the midsole 646 forward of the heel region, through the arch and/or the forefoot. In these regions, the plate can be fully embedded or encapsulated in the midsole, and further optionally not visible on the exterior of the sole assembly.

Figure 17:
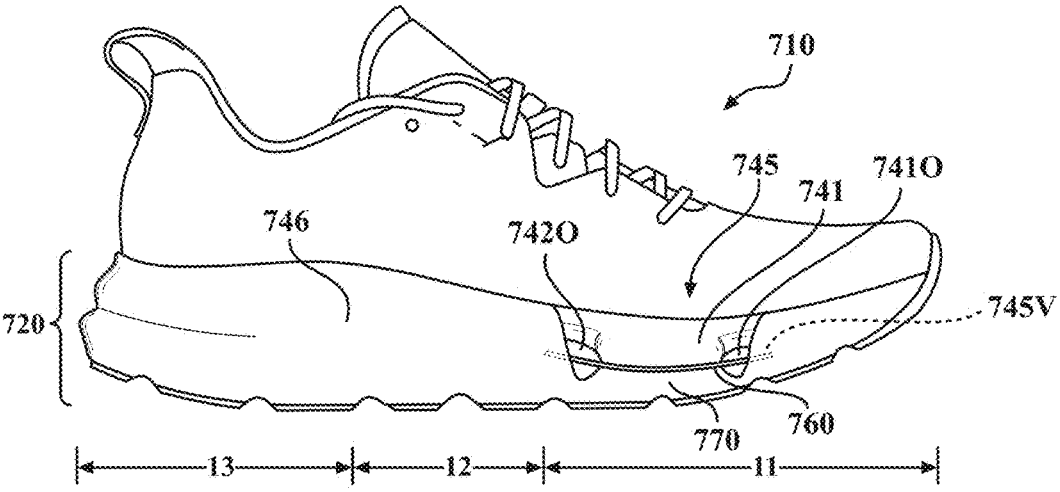
FIG. 17 is a side view of a sole assembly of a seventh alternative embodiment having an isolated pillar pod and plate in the forefoot region, with a solid or continuous midsole in the arch region and/or heel region.

A seventh alternative embodiment of the footwear is shown in FIG. 17 and generally designated 710. This embodiment can be identical or similar to the embodiments described above in structure, function and operation with several exceptions. For example, this embodiment can include a sole assembly 720 including an isolated pillar pod 745 and plate 760 in the forefoot region 11, with a solid or continuous midsole 746 in the heel region 13 and/or arch region 12. A plate 760 can be sandwiched between the upper and lower midsoles 740, 770 in the isolated pillar pod 745, above the outsole 750. In this embodiment, the isolated pillar pod can include an enlarged upper pillar 741 which like the other embodiments herein can be a pair of lateral and medial pillars, which can be disposed under the metatarsal heads of the wearer. This enlarged upper pillar can be larger in volume and area than the other upper pillars described above and can be centered under a ball of the user's foot, and/or the metatarsal heads of bones in the user's foot. Otherwise, this upper pillar can be identical or similar to the upper pillars 41, 42 described in the current embodiment above, and can include the various elements and components thereof. The upper pillar and plate can define at least one upper void that can be similar or identical in structure, function and operation to the upper opening or upper void 41O described in the current embodiment above and including all the pillar walls and surfaces of that void or others described in the current embodiment, which will not be described again here.

The plate 760 can define one or more indentations in this region, between the upper pillars, the indentations and characteristics of the plate being similar to that of the plate 60 in the embodiment described above. Although not shown, the plate 660 in the forefoot region can include one or more branding bridges which can include one or more indicia elements of the type as described above. The plate also can include one or more pillar recesses and thickened regions as explained in connection with the current embodiment first described above, with the pillars fitting into these recesses, and positioned with respective shoulders of those recesses as with the embodiments above.

The pillar pod 745 also can include a lower midsole 770 under the upper pillar 741. This lower midsole can be a solid continuous midsole with only minor voids or openings 741O, 742O. The lower midsole can transition to the remainder of the midsole 746, which can extend rearward to the arch and heel regions.

As shown in FIG. 17, the upper pillar and the plate can be spatially confined to a pillar pod 745, which can be defined in the forefoot region 13 of the sole assembly. The pillar pod 745 can be disposed in a recess or void 745V that is defined in a midsole 746. The midsole can be a solid, continuous midsole that extends from the forefoot to the heel and can be continuous with the lower midsole 770 under the plate and the portion in front of the plate. The void can be defined in the forefoot region of the solid midsole. Rearward of the pod 745, the midsole can extend through the arch region 12 and the heel region 13. This portion of the midsole 746 can be void of any openings, voids, pillars and/or the plate. The plate 760 can extend through the pod and void 745V. In some cases, forward and rearward ends 761 and 762 of the plate 760 can extend into the walls of the midsole 746 bounding the void. The plate can be embedded, fused, adhered and/or bonded to the midsole in these regions to provide securement of the plate therein. Optionally, although shown as extending only to the end 761, ending in the heel or arch region, the plate can extend within the midsole 746 rearward into the arch and/or heel region. In these regions, the plate can be fully embedded or encapsulated in the midsole, and further optionally not visible on the exterior of the sole assembly.

Figure 18:
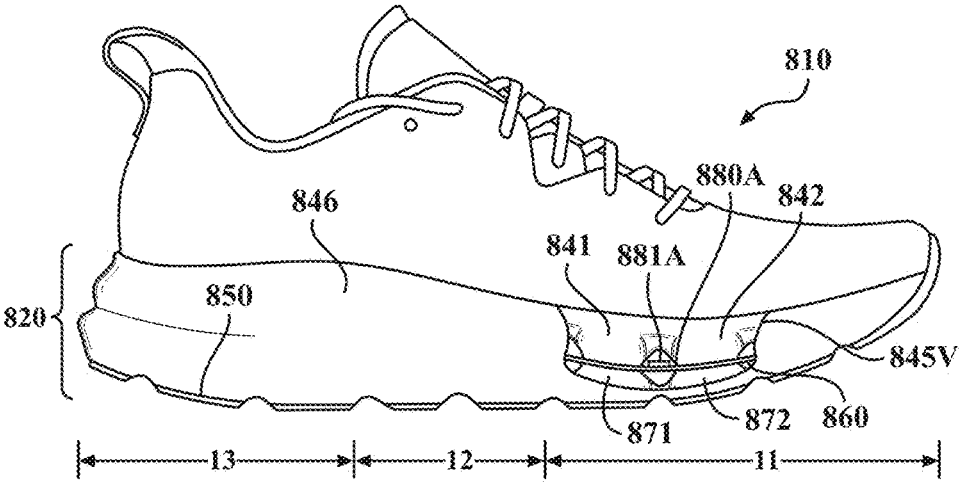
FIG. 18 is a side view of a sole assembly of an eighth alternative embodiment having an isolated pillar pod and plate in the forefoot region, with a solid or continuous midsole in the arch region and/or heel region.

An eighth alternative embodiment of the footwear is shown in FIG. 18 and generally designated 810. This embodiment can be identical or similar to the embodiments described above in structure, function and operation with several exceptions. For example, this embodiment can include a sole assembly 820 including an isolated pillar pod 845 and plate 860 in the forefoot region 11, with a solid or continuous midsole 846 in the arch region 12 and/or heel region 13. A plate 860 can be sandwiched between the upper and lower midsoles 840, 870 in the isolated pillar pod 845, above the outsole 850.

In this embodiment, the isolated pillar pod can include upper pillars 841, 842, which like the other embodiments herein can be pairs of lateral and medial pillars. These upper pillars can be identical or similar to the upper pillars 41, 42 described in the current embodiment above, and can include the various elements and components thereof. The upper pillars and plate can define at least one upper void that can be similar or identical to the upper opening or upper void 41O described in the current embodiment above and including all the pillar walls and surfaces of that void or others described in the current embodiment, which will not be described again here. The lower pillars 871, 872, which like the other embodiments herein can actually be pairs of lateral and medial pillars. These lower pillars can be identical or similar to the lower pillars 71, 72 described in the current embodiment above, and can include the various elements and components thereof. The upper pillars and plate can define at least one upper void that can be similar or identical to the upper opening or upper void 41O described in the current embodiment above and including all the pillar walls and surfaces of that void or others described in the current embodiment, which will not be described again here. The lower pillars and plate can define at least one lower void that can be similar or identical to the upper opening or lower void 71O described in the current embodiment above, including all the pillar walls and surfaces of that void or others described in the current embodiment, which will not be described again here.

The plate 860 can define one or more indentations within the pillar pod 845, between the upper pillars, the indentations and characteristics of the plate being similar to that of the plate 60 in the embodiment described above. Further, the plate 860 in this region can include one or more branding bridges 880A, which can include one or more indicia elements 881A. The branding bridge can be similar or identical to the branding bridge 80 described in connection with the current embodiment above, and the indicia element can be similar or identical to the indicia element 81 described above. The plate also can include one or more pillar recesses and thickened regions as explained in connection with the current embodiment first described above, with the pillars fitting into these recesses, and positioned with respective shoulders of those recesses as with the embodiments above.

As shown in FIG. 18, the upper and lower pillars, and the plate can be spatially confined to a pillar pod 845, which can be defined in the forefoot region 11 of the sole assembly. The pillar pod 845 can be disposed in a recess or void 845V that is defined in a midsole 846. The midsole can be a solid, continuous midsole that extends from the forefoot to the heel. The void can be defined in the forefoot regions of the solid midsole. Rearward of the pod 845, the midsole can extend through the arch region 12 and the heel region 13. This portion of the midsole 846 can be void of any openings, voids, pillars and/or the plate. The plate 860 can extend through the pod and void 845V, and optionally into the midsole, where it can be embedded, fused, adhered and/or bonded to the midsole as described in the embodiments above.

Figure 19:
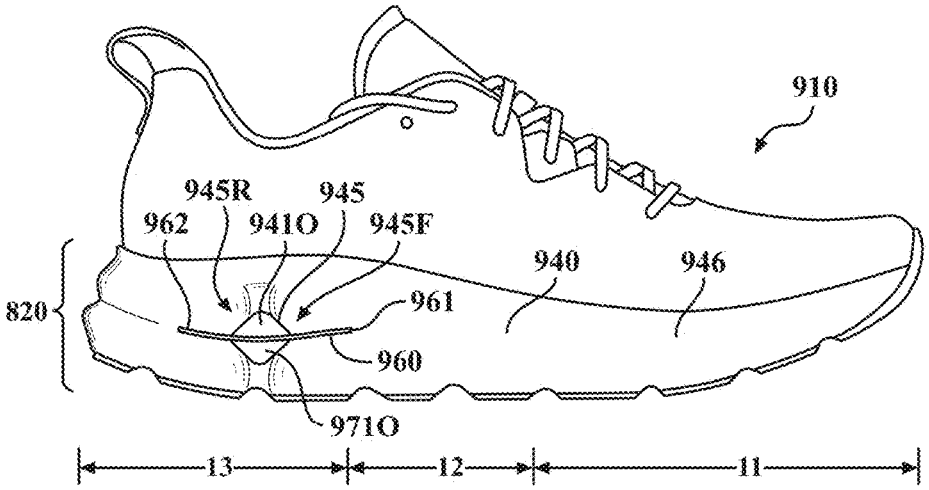
FIG. 19 is a side view of a sole assembly of a ninth alternative embodiment having a support plate included in a hybrid midsole suspension void in a heel region.
Figure 19A:
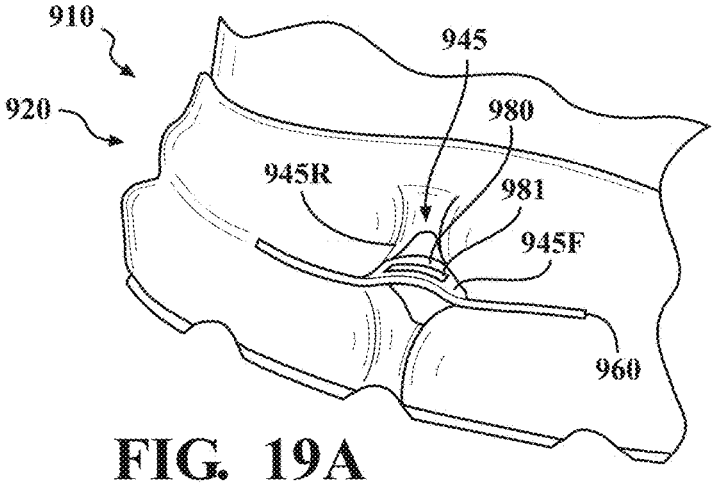
FIG. 19A is a perspective view of the heel region of the ninth alternative embodiment illustrating a branding bridge of the support plate.
Figure 19B:
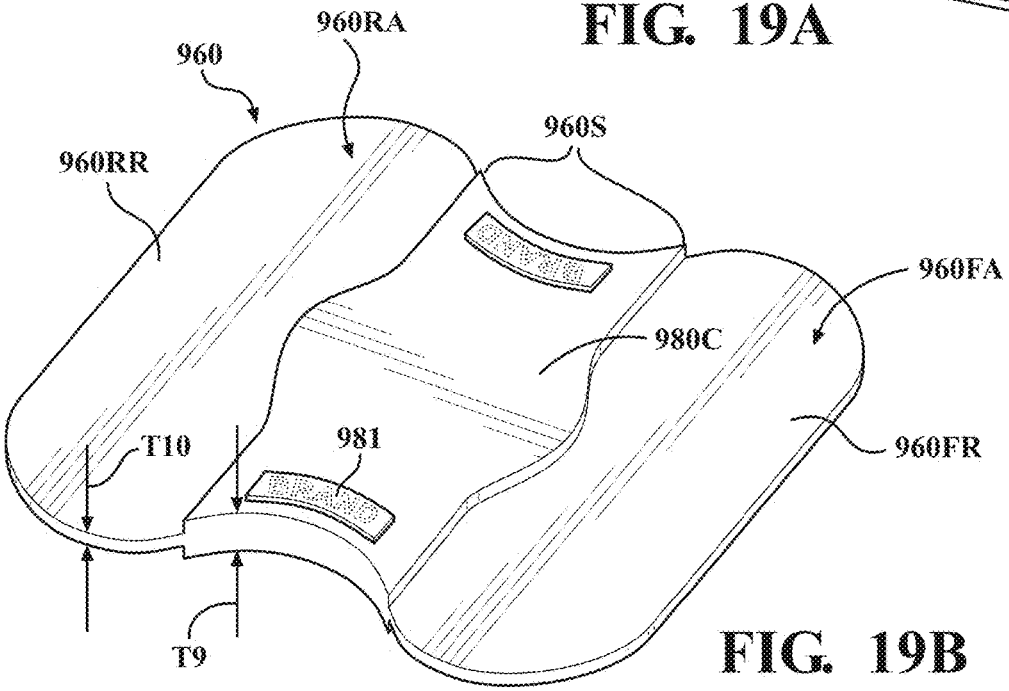
FIG. 19B is a perspective view of the support plate of the ninth alternative embodiment illustrating the branding bridge of the support plate.

A ninth alternative embodiment of the footwear is shown in FIGS. 19, 19A and 19B generally designated 910. This embodiment can be identical or similar to the embodiments described above in structure, function and operation with several exceptions. For example, this embodiment can include a sole assembly 920 including a support plate 960 included in a hybrid midsole suspension void 945 in a heel region 13 of the sole assembly 920. The midsole suspension void can be defined by a unitary, solid midsole (except for the void in the heel) that extends from the forefoot to the heel regions. The support plate 960 can extend through the void, from a forward wall 945F to a rearward wall 945R thereof. The void can include an upper void 941O and a lower void 971O, defined above and below the plate respectively. These voids can extend completely through the midsole and can be similar to the upper and lower voids described above in connection with the current embodiment.

The voids or openings in this construction in the heel can operate similar or identical to the construction shown in FIGS. 6 and 7 and described above. For example, the voids in this embodiment can be disposed below a heel H of a user when the footwear is worn by a user. A user can exert a heel force HF on the upper wall or top wall that extends over the void 941O. The heel force HF can be produced by the normal weight of the user through the heel H of the user when the user is standing or stationary. The voids 941O, 971O are generally open and have an arched or domed shape, optionally slightly parabolic shape as described in connection with that embodiment. When a user engages in an activity, such as hiking or trail running or some other activity, upon heel strike, the user's heel will exert a greater heel force HFA through the sole assembly 920, in which case, the upper and lower midsole components and respective voids function similar or identical to the embodiment shown in FIGS. 6 and 7.

As shown in FIG. 19A, the plate 960 can define one or more indentations in this heel region, between the front and rear walls 945F and 945R. The indentations and characteristics of the plate being similar to that of the plate 60 in the embodiment described above. Further, the plate 960 in this region can include one or more branding bridges 980, which can include one or more indicia elements 981. The branding bridge can be similar or identical to the branding bridge 80 described in connection with the current embodiment above, and the indicia element can be similar or identical to the indicia element 81 described above.

With reference to FIG. 19B, the plate 960 can include forward 960FR and rearward 960RR pillar recesses as explained in connection with the current embodiment first described above, with the portions of the midsole 940 fitting into these recesses and positioned with respective shoulders 960S abutting the respective front and rear walls of the void. The plate as shown also can include varying thicknesses T9 and T10, where the thickness T9 spanning the void can be greater than the thickness T10 embedded in, encapsulated in, penetrating into or otherwise disposed in the walls forward and rearward of the void and corresponding to the recesses 960RR and 960FR. In some applications, the midsole can be molded over the parts 960RA and 960FA of the plate and fused or bonded thereto, thereby securing the plate to the midsole in the opening formed over the central part 980C of the plate. The material of the midsole can abut against the shoulders 960S.

Optionally, the flexibility of the plate in the region of the recesses, due to the securement of the plate there to the midsole, can be brought close to or matched with the flexibility or bending resistance of the portions of the plate that have the greater thickness T9. By having thicker portions of the plate with the thickness T9 within the void, and securing the midsole to the to the upper and lower surfaces of the plate in the recesses 960RR and 960FR with the lesser thickness T10, the plate 60 can include a generally uniform and consistent flexibility and/or rigidity from front to rear and side to side of the plate to offer a certain level of stability, despite the different thicknesses of the plate. This in turn can translate to greater fore to aft and side to side lateral stability and consistency throughout the plate and underfoot.

Figure 20:
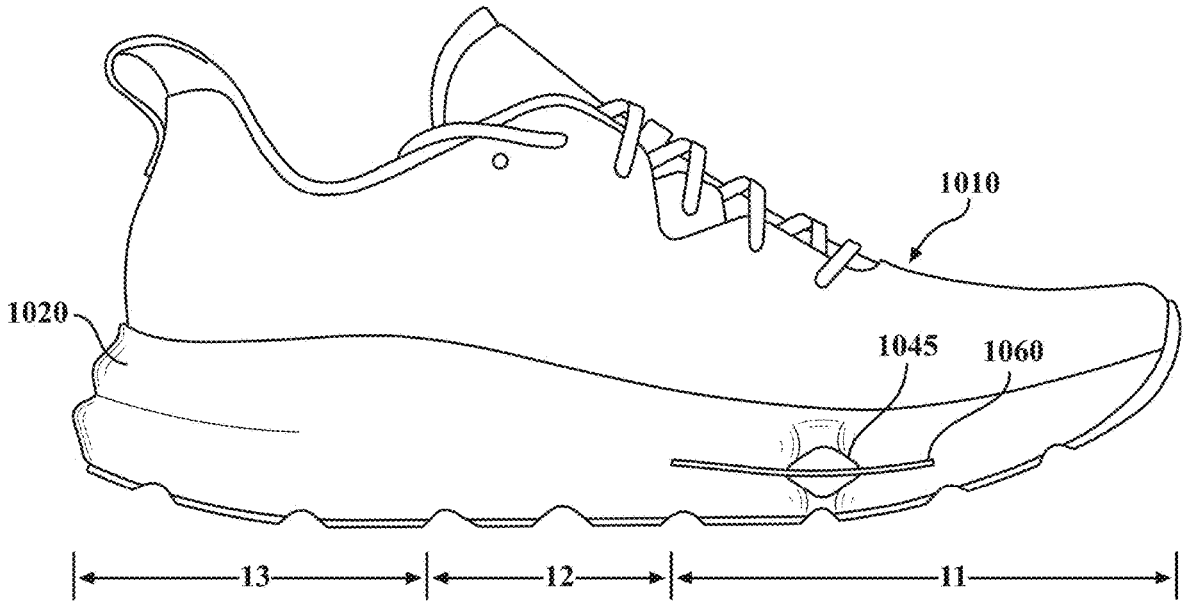
FIG. 20 is a side view of a sole assembly of a tenth alternative embodiment of the sole assembly having a support plate included in a hybrid midsole suspension void in a forefoot region.

A tenth alternative embodiment of the footwear is shown in FIG. 20 and generally designated 1010. This embodiment can be identical or similar to the embodiments described above, particularly that shown in FIGS. 19, 19A, 19B, in structure, function and operation with several exceptions. For example, this embodiment can include a sole assembly 1020 including a support plate 1060 included in a hybrid midsole suspension void 1045. Instead of being disposed in the heel region as shown in FIG. 19, in this embodiment, the void is disposed in the forefoot region 11, optionally with the void 1045 centered or placed under the distal heads of the metatarsals and/or under the ball of the user's foot. The midsole suspension void can be defined by a unitary, solid midsole (except for the void in the forefoot) that extends from the forefoot to the heel regions. This embodiment also can include a support plate 1060 extending through the void, similar or identical to the plate 960 described in the embodiment above. Rearward of the plate and void, and optionally forward thereof, the midsole can be of solid and unitary construction, from top to bottom of the midsole, with no voids or plates in those sections.

Figure 21:
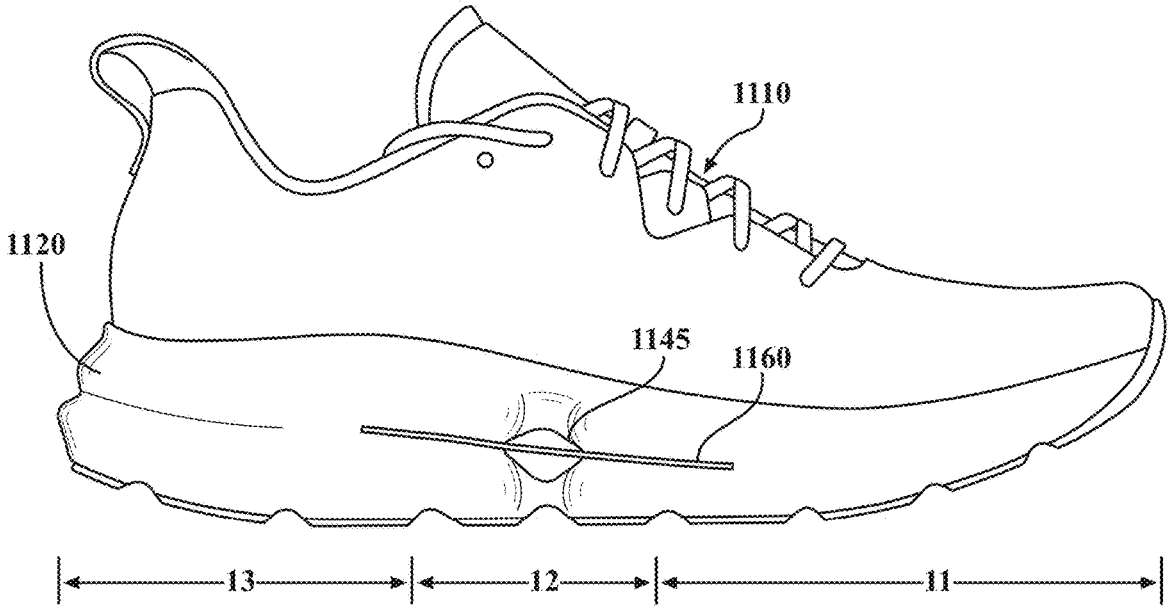
FIG. 21 is a side view of a sole assembly of an eleventh alternative embodiment of the sole assembly having a support plate included in a hybrid midsole suspension void in an arch region.

An eleventh alternative embodiment of the footwear is shown in FIG. 21 and generally designated 1110. This embodiment can be identical or similar to the embodiments described above, particularly that shown in FIGS. 19, 19A, 19B, in structure, function and operation with several exceptions. For example, this embodiment can include a sole assembly 1120 including a support plate 1160 included in a hybrid midsole suspension void 1145. Instead of being disposed in the heel regions as shown in FIG. 19, in this embodiment, the void is disposed in the arch region 12. The midsole suspension void can be defined by a unitary, solid midsole (except for the void in the forefoot) that extends from the forefoot to the heel regions. This embodiment also can include a support plate 1160 extending through the void, similar or identical to the plate 960 described in the embodiment above. Rearward of the plate and void, and optionally forward thereof, the midsole can be solid and unitary construction, from top to bottom of the midsole, with no voids or plates in those sections.

Figure 22:
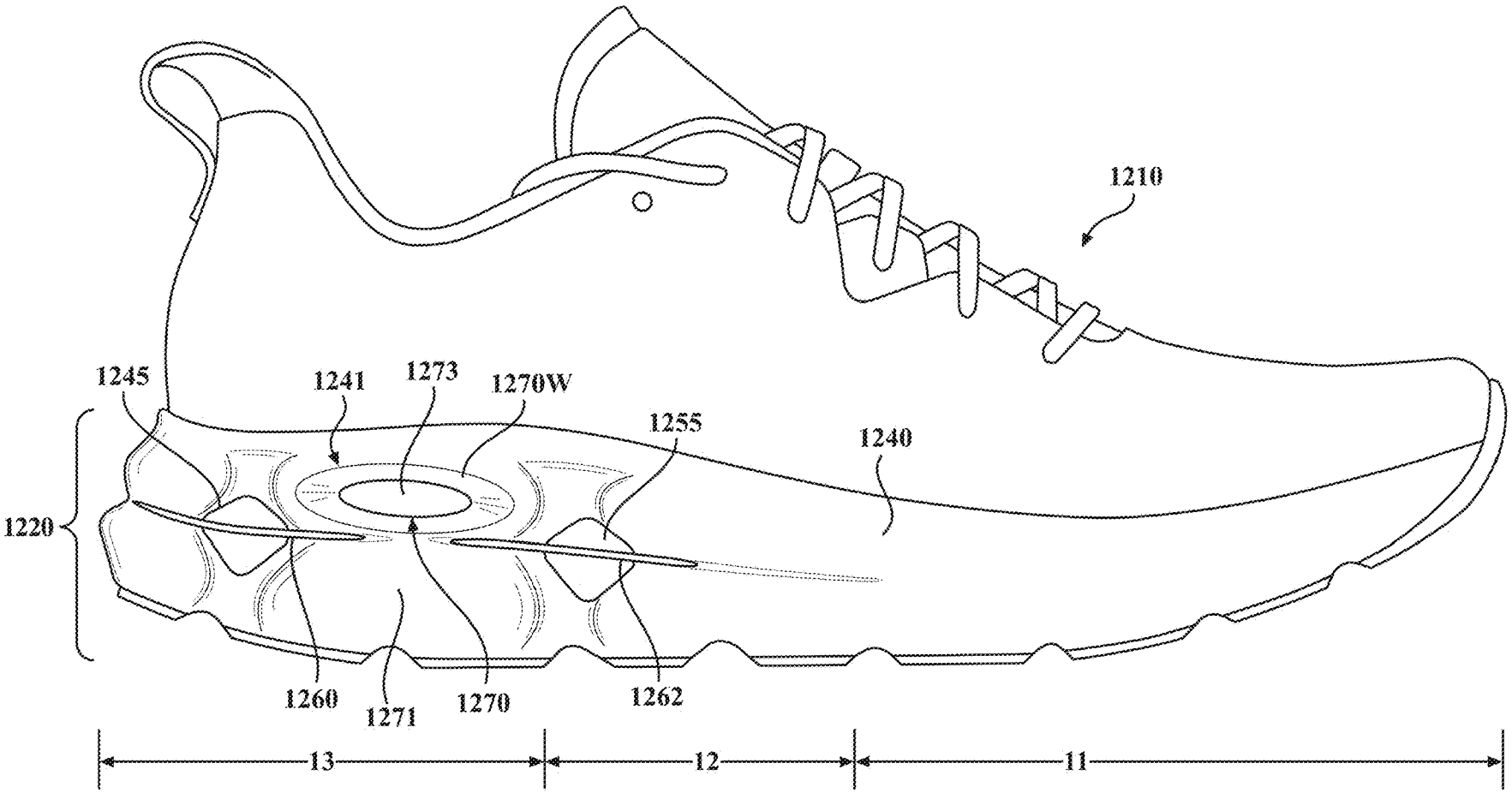
FIG. 22 is a side view of a sole assembly of a twelfth alternative embodiment of the sole assembly having a support plate included in a suspension unit having a primary pillar and suspension voids flanking the primary pillar in the heel region.
Figure 22A:
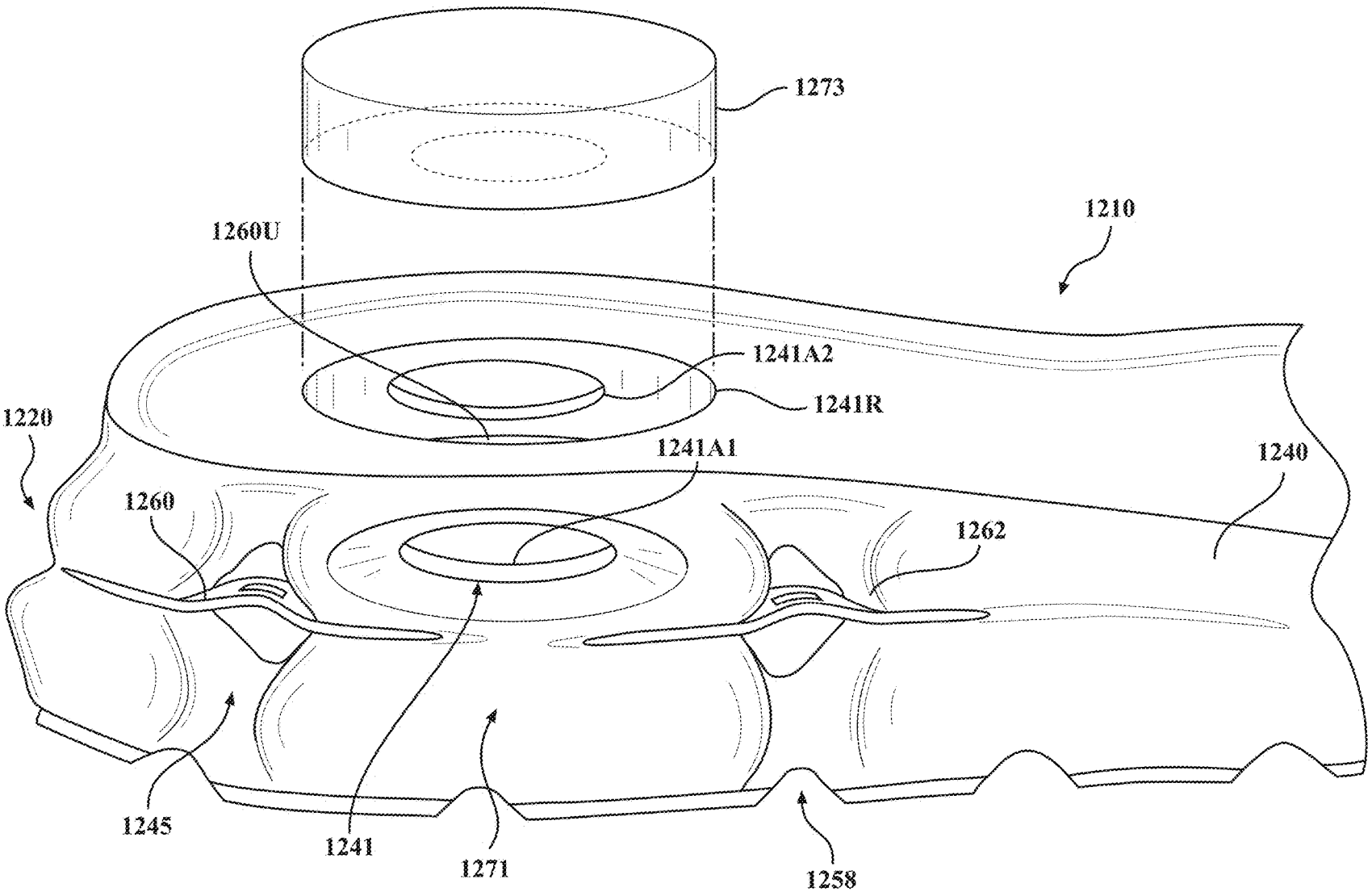
FIG. 22A is a perspective view of the sole assembly of the twelfth embodiment in a preassembled state with a heel pad to be installed relative to the primary pillar.

A twelfth alternative embodiment of the footwear is shown in FIG. 22-22A and generally designated 1210. This embodiment can be identical or similar to the embodiments described above, particularly that shown in FIGS. 19, 19A, 19B, in structure, function and operation with several exceptions. For example, this embodiment can include a sole assembly 1220 including a support plate 1260 included in a hybrid midsole suspension void 1245. In this embodiment, however, a second hybrid midsole suspension void 1255 is also included forward of the first void 1245. Each of these voids can extend completely through the midsole from a medial side to the lateral side, in the heel region and/or part of the arch region. The plate 1260 can extend forwardly through this void as well, or a second plate 1262 can be disposed through the void. These voids and the plate or plates spanning therethrough can be identical to the plates described above, and can include respective recesses, shoulders, thicknesses, indentations on the outer perimeters of the plate 960 or the other plate 60 described in the embodiments above. Although not shown, the plate can include branding bridges and indicia elements, similar to those described in other embodiments above, in one or more of the voids 1245, 1255, on each or both lateral and medial sides of the sole assembly 1220. The midsole suspension voids 1245, 1255 can be defined by a unitary, solid midsole (except for the voids in the heel) that extends from the forefoot to the heel regions.

With reference to FIGS. 22 and 22A, this embodiment optionally can include an upper heel puck unit or primary pillar 1241 disposed over the plate 1260, and a lower pillar 1271 disposed below the plate. The lower pillar can extend from the lateral side to the medial side of the sole assembly, and can be disposed between the voids 1245 and 1255 below the plate. The upper pillar can extend from the lateral side to the medial side of the sole assembly, and can be disposed between the voids 1245 and 1255 above the plate. The upper pillar, primary pillar or heel puck unit 12 can define a heel puck recess 1241R in the heel region, between the voids 1245 and 1255. The recess 1241R can receive a heel puck 1273 therein. The recess can be sized and shaped to corresponds to the puck. The recess 1241R can extend to the plate 1260 so that the bottom of the recess is the upper surface 1260U of the plate. The puck thus can engage or rest on the plate directly when installed in the recess to transfer forces therethrough to the plate. The puck optionally can be made of a different material or can have a different durometer than the midsole 1240 to provide impact absorption and cushion to a heel of the wearer. Although shown between the voids 1245 and 1255, the puck can be offset farther forward or rearward. closer or farther from one or both of the voids.

Optionally, the primary pillar or upper pillar can include one or more sidewall apertures 1241A1 and 1241A2. These apertures can extend from the exterior of the pillar to the recess 1241R. With these apertures, a viewer can view the puck 1273 therethrough. In some cases, the puck can be a contrasting color from the remainder of the midsole so that the puck is easily identifiable. Of course, the puck, puck recess, and apertures can be absent in some applications, and the upper pillar 1245 can be made of a different material or same material as the remainder of the midsole but with a different durometer.

Further optionally, as shown, the puck 1273 can be of a round or cylindrical shape, although other shapes can be selected depending on the application. The shape can match the recess 1241R in the primary pillar 1241, so that the puck can be easily installed therein, with its exterior surface optionally adjacent and/or engaging the sidewall of the recess facing the puck 1273.

The following additional statements are provided, the numbering of which is not to be construed as designating levels of importance.

Statement 1. A sole assembly comprising: an upper midsole or a lower midsole extending along a longitudinal axis and including a first pillar on a side of the longitudinal axis, a second pillar disposed forward of the first pillar on the side and separated from the first pillar by a void that extends toward the longitudinal axis; a corresponding lower midsole or upper midsole including a solid, continuous foam portion disposed above or below the first pillar and the second pillar; a plate sandwiched between the upper midsole and the lower midsole, the plate including a plate edge that extends to and is visible between the pillars and the solid continuous foam portion from a side view of the sole assembly.

Statement 2: The sole assembly of Statement 1, wherein the first and second pillars are in a heel region, an arch region and/or a forefoot region.

Statement 3: The sole assembly of any preceding Statement, wherein the upper midsole includes the first and second pillars and the lower midsole includes the solid continuous foam portion.

Statement 4: The sole assembly of any preceding Statement, wherein the lower midsole includes the first and second pillars and the upper midsole includes the solid continuous foam portion.

Statement 5: The sole assembly of any preceding Statement, wherein the upper midsole includes the first and second pillars in a heel region, wherein the lower midsole includes the solid continuous foam portion in the heel region and/or arch region, wherein the upper midsole includes the solid continuous foam portion in the arch region and/or the forefoot region, wherein the lower midsole includes third and fourth pillars in a forefoot region, heel region and/or arch region.

Statement 6: The sole assembly of any preceding Statement, wherein the lower midsole includes the first and second pillars in a heel region, wherein the upper midsole includes the solid continuous foam portion in the heel region and/or arch region, wherein the lower midsole includes the solid continuous foam portion in the arch region and/or the forefoot region, wherein the upper midsole includes third and fourth pillars in a forefoot region.

Statement 7: A sole assembly comprising: a midsole; a pillar pod disposed in at least one of a heel region, an arch region and a heel region of the midsole, the pillar pod including a first pillar, a second pillar disposed forward of the first pillar and separated from the first pillar by a void that extends through the sole from a lateral side to a medial side; a plate engaging the first pillar and the second pillar, the plate including a plate edge that extends to and is visible between the pillars from a side view of the sole assembly.

Statement 8: The sole assembly of any preceding Statement, wherein the pillars are disposed in a pillar pod void.

Statement 9: The sole assembly of any preceding Statement, wherein a solid continuous foam portion of the midsole engages the plate opposite the pillars.

Statement 10: The sole assembly of any preceding Statement, wherein the solid continuous foam portion of the midsole extends forward and/or rearward of the pod.

Statement 11: The sole assembly of any preceding Statement, wherein the first and second pillars are in a heel region, an arch region and/or a forefoot region.

Statement 12: A sole assembly comprising: a unitary, solid midsole; a first midsole suspension void defined by a unitary, solid midsole in at least one of a heel region, an arch region and a forefoot region; a support plate extending through the void from a forward wall to a rearward wall of the void, the support plate optionally extending into the midsole through the forward wall and rearward wall.

Statement 13: The sole assembly of any preceding Statement, wherein the void extends completely through the midsole.

Statement 14: The sole assembly of any preceding Statement, wherein the void extends above and/or below the plate.

Statement 15: The sole assembly of any preceding Statement, wherein the plate includes a first thickness and a second thickness, different from the first thickness.

Statement 16: The sole assembly of any preceding Statement, wherein the plate includes forward and rearward recesses, wherein the midsole is disposed in the recesses.

Statement 17: The sole assembly of any preceding Statement, wherein the plate extends forwardly in the midsole and is concealed, embedded and/or disposed therein.

Statement 18: The sole assembly of any preceding Statement, wherein the plate includes a branding bridge and an indicia element, optionally wherein the branding bridge includes an indentation extending inward toward a longitudinal axis of the sole assembly, optionally wherein the branding bridge extends between adjacent forward and rearward pillars in a void, optionally wherein the branding bridge includes an upper surface visible in an upper void and a lower surface visible in a lower void under the upper void and below the branding bridge, optionally wherein the branding bridge curves outward around adjacent pillars and transitions to be concealed by those pillars, optionally wherein the sole assembly includes a recess above and below the branding bridge so that indicia element on the branding bridge can be viewed from above the bridge and below the bridge.

Statement 19: The sole assembly of any preceding Statement, comprising a second midsole suspension void defined by the unitary, solid midsole forward of the first midsole suspension void, in a heel region; a puck recess defined above the plate between the first and second suspension voids; and a heel puck disposed in the recess.

Statement 20: The sole assembly of any preceding Statement, wherein a heel puck aperture extends from the puck recess to an exterior of the solid midsole between the first and second midsole void, wherein the puck is visible to a viewer through the heel puck aperture.

In the above embodiments, the placement, numbers, orientations and configurations of the upper midsole and the lower midsole, the pillars, the plate, the voids, the openings, the walls, the compartments, and other components can vary throughout the sole assembly to provide different cushioning, energy return, stability or other properties. Moreover, the foregoing embodiments and their features, components and/or elements can be mixed and matched with and from one embodiment to another.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. Moreover, as is self-evident regarding any of the embodiments herein, the various components and configurations of any of them can be mixed and matched with other components and configurations of any other embodiment or embodiments. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A sole assembly comprising:

an upper midsole extending along a longitudinal axis and including a first upper pillar on a lateral side of the longitudinal axis, a second upper pillar disposed forward of the first upper pillar on the lateral side and separated from the first upper pillar by an upper lateral void, a third upper pillar disposed on a medial side of the longitudinal axis, and a fourth upper pillar disposed forward of the third upper pillar on the medial side and separated from the third upper pillar by an upper medial void;

a lower midsole including a top surface that faces toward the first upper pillar, the second upper pillar, the third upper pillar and the fourth upper pillar, and an opposing bottom surface, the lower midsole including a first lower pillar on the lateral side, a second lower pillar disposed forward of the first lower pillar on the lateral side and separated from the first lower pillar by a lower lateral void disposed below the upper lateral void, a third lower pillar disposed on a medial side, and a fourth lower pillar disposed forward of the third lower pillar on the medial side and separated from the third lower pillar by a lower medial void disposed below the upper medial void; and a plate between the upper midsole and the lower midsole, the plate including a plate upper surface and a plate lower surface, the plate extending between the first upper pillar and the second upper pillar, and separating the upper lateral void from the lower lateral void, the plate upper surface facing upward toward the upper lateral void, the plate lower surface facing downward toward the lower lateral void, wherein the plate includes a branding bridge with an indicia element thereon, wherein the branding bridge includes a branding bridge upper surface visible in the upper lateral void and a branding bridge lower surface visible in a lower lateral void under the upper lateral void, wherein the upper lateral void includes an upper portion that is bounded by a tangential surface of the upper midsole that contours toward the longitudinal axis, wherein the branding bridge projects beyond the tangential surface on the lateral side in an upper perspective view of a user viewing the branding bridge through the upper lateral void adjacent the tangential surface such that the indicia element is visible to the user in the upper perspective view.

2. The sole assembly of claim 1, wherein the branding bridge curves outward around the first upward pillar and the first lower pillar, and the second upper pillar and the second lower pillar, on the lateral side, wherein the branding bridge defines an indentation that extends inward toward the longitudinal axis.

3. The sole assembly of claim 1, wherein the upper lateral void and the lower lateral void extend respectively above and below the branding bridge so that indicia element on the branding bridge can be viewed from above the bridge and below the bridge by the user.

4. The sole assembly of claim 1, wherein the lower lateral void and the lower medial void are contiguous to form a lower opening extending transversely through the sole assembly from the lateral side to the medial side below the plate lower surface, whereby the user can view through the lower opening completely through the sole assembly from the lateral side to the medial side.

5. The sole assembly of claim 1, wherein the first upper pillar is disposed above and vertically aligned with the first lower pillar, wherein the first upper pillar includes a first upper pillar lower sidewall, wherein the first lower pillar includes a first lower pillar upper sidewall, wherein the lateral plate edge includes a first lateral edge that protrudes laterally beyond the first upper pillar lower sidewall and the first lower pillar upper sidewall between the first upper pillar and the first lower pillar, wherein the first lateral edge is visible to the user from an upper perspective view of the sole assembly.

6. The sole assembly of claim 1, wherein the branding bridge extends between the first upper pillar and the second upper pillar, wherein the branding bridge upper surface extends to the longitudinal axis, wherein the branding bridge includes a curved outer edge.

7. The sole assembly of claim 1, wherein the branding bridge includes the indicia element displayed on the plate upper surface and visible within the upper lateral void between the first upper pillar and the second upper pillar.

8. The sole assembly of claim 1, wherein the upper medial void and the lower medial void extend respectively above and below the branding bridge so that indicia element on the branding bridge can be viewed from above the bridge and below the bridge by the user.

9. The sole assembly of claim 1, wherein the indicia element is visible when a user views the sole assembly from a bottom thereof.

10. A sole assembly comprising:

an upper midsole extending along a longitudinal axis and including a first upper pillar on a lateral side of the longitudinal axis, a second upper pillar disposed forward of the first upper pillar on the lateral side and separated from the first upper pillar by an upper lateral void, a third upper pillar disposed on a medial side of the longitudinal axis, and a fourth upper pillar disposed forward of the third upper pillar on the medial side and separated from the third upper pillar by an upper medial void;

a lower midsole including a top surface that faces toward the first upper pillar, the second upper pillar, the third upper pillar and the fourth upper pillar, and an opposing bottom surface, the lower midsole including a first lower pillar on the lateral side, a second lower pillar disposed forward of the first lower pillar on the lateral side and separated from the first lower pillar by a lower lateral void disposed below the upper lateral void, a third lower pillar disposed on a medial side, and a fourth lower pillar disposed forward of the third lower pillar on the medial side and separated from the third lower pillar by a lower medial void disposed below the upper medial void; and a plate between the upper midsole and the lower midsole, the plate including a plate upper surface, a plate lower surface, a lateral plate edge and a medial plate edge,the plate extending between the first upper pillar and the second upper pillar, and separating the upper lateral void from the lower lateral void, the plate upper surface facing upward toward the upper lateral void, the plate lower surface facing downward toward the lower lateral void, wherein the plate includes a branding bridge with an indicia element thereon, wherein the branding bridge includes a branding bridge upper surface visible in the upper lateral void and a branding bridge lower surface visible in a lower lateral void under the upper lateral void, wherein the plate defines a plurality of indentations extending inward from the lateral plate edge and the medial plate edge, the plurality of indentations including a first indentation defined by the lateral plate edge and overlapping the branding bridge on the lateral side.

11. A sole assembly comprising:

an upper midsole extending along a longitudinal axis and including a first upper pillar on a side of the longitudinal axis, a second upper pillar disposed forward of the first upper pillar on the side and separated from the first upper pillar by an upper void that extends toward the longitudinal axis;

a lower midsole including a top surface that faces toward the first upper pillar and the second upper pillar, an opposing bottom surface and a first lower pillar on the side, a second lower pillar disposed forward of the first lower pillar on the side and separated from the first lower pillar by a lower void that extends toward the longitudinal axis; and a plate sandwiched between the upper midsole and the lower midsole, the plate including a branding bridge that extends to and is visible to a user between the first upper pillar and the first lower pillar from an upper perspective view of the sole assembly, wherein the first upper pillar includes a first pillar outer wall disposed outside the upper void, wherein the second upper pillar includes a second pillar outer wall disposed outside the upper void, wherein an indicia element is disposed on the branding bridge and inset from the first pillar outer wall and the second pillar outer wall such that the indicia element is closer to the longitudinal axis than the first pillar outer wall.

12. The sole assembly of claim 11, wherein the plate includes a plate upper surface and a plate lower surface, wherein the plate separates the upper void from the lower void, wherein the plate upper surface faces upward toward the upper void, wherein the plate lower surface faces downward toward the lower void, wherein the plate upper surface is visible to the user from the upper perspective view of the sole assembly, wherein the plate lower surface is visible to a user from a lower perspective view of the sole assembly.

13. The sole assembly of claim 11, wherein the indicia element is in the form of at least one of raised indicia and recessed indicia along the plate.

14. The sole assembly of claim 11, wherein the indicia element includes a plurality of alphanumeric characters extending between the first upper pillar and the second upper pillar that are visible to the user, wherein the upper void is bounded by a tangential surface that curves into the upper void, wherein the plurality of alphanumeric characters are visible through the upper void and adjacent the tangential surface to the user from the upper perspective view.

15. The sole assembly of claim 12, wherein the indicia element is displayed on a plate upper surface corresponding to the branding bridge within the upper void.

16. A sole assembly comprising:

an upper midsole extending along a longitudinal axis and including a first upper pillar on a side of the longitudinal axis, a second upper pillar disposed forward of the first upper pillar on the side and separated from the first upper pillar by an upper void that extends toward the longitudinal axis;

a lower midsole including a top surface that faces toward the first upper pillar and the second upper pillar, an opposing bottom surface and a first lower pillar on the side, a second lower pillar disposed forward of the first lower pillar on the side and separated from the first lower pillar by a lower void that extends toward the longitudinal axis; and a plate sandwiched between the upper midsole and the lower midsole, the plate including a branding bridge that extends to and is visible to a user between the first upper pillar and the first lower pillar from an upper perspective view of the sole assembly, wherein the plate defines a plurality of indentations extending inward from a plate edge, the plurality of indentations including a first indentation defined by the plate edge and overlapping the branding bridge, the first indentation curving inward toward the longitudinal axis.

17. A sole assembly comprising:

an upper midsole extending along a longitudinal axis and including first upper pillar on a side of the longitudinal axis, a second upper pillar disposed forward of the first upper pillar on the side and separated from the first upper pillar by an upper void that extends inward from the side toward the longitudinal axis;

a lower midsole under the upper midsole including a first lower pillar on the side, a second lower pillar disposed forward of the first lower pillar on the side and separated from the first lower pillar by a lower void that extends toward the longitudinal axis, the lower void disposed above the upper void; and a plate sandwiched between the upper midsole and the lower midsole, the plate including a branding bridge visible between the first upper pillar and the first lower pillar from a side view of the sole assembly, wherein the upper void includes an upper portion that is bounded by a tangential surface of the upper midsole that wraps into the upper void, wherein the branding bridge is visible from an upper perspective view of a user through the upper void adjacent the tangential surface.

18. The sole assembly of claim 17, wherein the branding bridge extends between the first upper pillar and the second upper pillar, and between the first lower pillar and the second lower pillar, wherein the branding bridge includes an indicia element displayed on a plate upper surface and visible within the upper void between the first upper pillar and the second upper pillar by the user viewing the sole assembly from the upper perspective view thereof.

19. The sole assembly of claim 17, wherein the branding bridge projects laterally outward beyond the tangential surface in the upper perspective view of the user.

* * * * *